US011571015B2

(12) United States Patent
Williams

(10) Patent No.: US 11,571,015 B2
(45) Date of Patent: Feb. 7, 2023

(54) METHODS OF ASSEMBLING FILTERS AND SPACING DRUM SYSTEMS THEREOF

(71) Applicant: Altria Client Services LLC, Richmond, VA (US)

(72) Inventor: Dwight D. Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 556 days.

(21) Appl. No.: 16/548,985

(22) Filed: Aug. 23, 2019

(65) Prior Publication Data

US 2021/0051995 A1 Feb. 25, 2021

(51) Int. Cl.
*A24C 5/20* (2006.01)
*A24D 3/02* (2006.01)

(52) U.S. Cl.
CPC ..... *A24C 5/20* (2013.01); *A24D 3/0229* (2013.01); *A24D 3/0254* (2013.01); *A24D 3/0275* (2013.01)

(58) Field of Classification Search
CPC .... A24C 5/00; A24C 5/32; A24C 5/35; A24C 5/471; A24C 5/475; A24C 5/28; A24C 5/50; A24F 40/70; A24F 47/006; A24D 3/0287
USPC ..... 493/45, 46, 47, 48
See application file for complete search history.

(56) References Cited

U.S. PATENT DOCUMENTS 4,411,640 A * 10/1983 Hall ..... A24D 3/0225 493/46
7,479,098 B2 1/2009 Thomas et al.
8,172,739 B2 5/2012 Horn et al.
8,291,916 B2 10/2012 Belcastro et al.
8,337,374 B2 12/2012 Garthaffner et al.
8,808,153 B2 8/2014 Yanchev et al.
8,991,587 B2 3/2015 Hoffmann
9,089,163 B2 7/2015 Le Roux
10,039,313 B2 8/2018 Mironov
2004/0102299 A1 5/2004 Meyer et al.
(Continued)

FOREIGN PATENT DOCUMENTS

EP 2633769 A1 9/2013
EP 2658801 A1 11/2013
WO WO-2006019026 A1 2/2006

OTHER PUBLICATIONS

"FC8 Filter Rod Making Machine" Gulf Tobacco, <http://www.cigarettemanufacturingmachines.com/gd-fc8-filter-rod-making-machine/>, last accessed Oct. 9, 2018.
(Continued)

*Primary Examiner* — Andrew M Tecco
*Assistant Examiner* — Jacob A Smith
(74) *Attorney, Agent, or Firm* — Harness, Dickey & Pierce, P.L.C.

(57) ABSTRACT

A system includes system at least one dispenser configured to dispense to dispense a plurality of segments on a first conveying path and a spacing drum configured to receive a number of the plurality of segments per revolution of the drum and configured to release the number of segments on a second conveying path at a segment-release spacing and a segment-release speed along the conveying path, the number of the plurality of segments being at least three and the number of segments released by the spacing drum forming a filter element.

8 Claims, 17 Drawing Sheets

(56) References Cited

U.S. PATENT DOCUMENTS

| | | | | |
|---|---|---|---|---|
| 2006/0196513 | A1 | 9/2006 | Atwell et al. | |
| 2009/0145449 | A1* | 6/2009 | Cieslikowski | A24D 3/0287 131/280 |
| 2011/0290263 | A1 | 12/2011 | Braunshteyn et al. | |
| 2015/0181926 | A1* | 7/2015 | Slowik | B65G 47/846 198/803.14 |
| 2015/0251854 | A1* | 9/2015 | Druzdzel | A24C 5/35 198/339.1 |
| 2017/0273352 | A1* | 9/2017 | Grant | A24F 40/70 |

OTHER PUBLICATIONS

"Solaris: filter flexible multi-segment filter combiner" ITM Group, <https://www.itmgroup.eu/solutions/discover-our-platforms/solaris-filter-combiner>, last accessed Oct. 9, 2018.

* cited by examiner

METHODS OF ASSEMBLING FILTERS AND SPACING DRUM SYSTEMS THEREOF

FIELD

Some example embodiments relate generally to rod making in the manufacture of fibrous material or filter rods and/or fibrous material products.

ENVIRONMENT

Many linear fed garniture machines have two hoppers. If a combined filter element uses more than two filter segments, multiple combining operations are used.

SUMMARY

Multiple combining operations increase the complexity and materials used in generating the combined filter element. The inventors have discovered systems to reduce the number of steps where multiple segments can be combined into a single element, thereby reducing the materials (e.g., paper and glue) used in the combining operation.

In some example embodiments, a single spacing drum may be used to combine three filter segments into a single filter element.

In some example embodiments, two space drums are used to combine four filter segments into a single filter element. A first drum may combine filter segments from two hoppers to form a combined segment and a second drum combines the combined segment with filter segments from two other hoppers.

In at least some example embodiments, a system includes at least one dispenser configured to dispense a plurality of segments on a first conveying path and a spacing drum configured to receive a number of the plurality of segments per revolution of the drum and configured to release the number of segments on a second conveying path at a segment-release spacing and a segment-release speed along the conveying path, the number of the plurality of segments being at least three and the number of segments released by the spacing drum forming a filter element.

In at least some example embodiments, the system further includes a single wrapper configured to perform a single wrapping of the filter element.

In at least some example embodiments, the single wrapper is a garniture.

In at least some example embodiments, the spacing drum includes radial flight profile including continuous arcs extending from a first side of the spacing drum to a second side of the spacing drum.

In at least some example embodiments, the continuous arcs transition the number of segments from the first side of the spacing drum to the second side of the spacing drum by pushing the segments as the segments travel from the first side of the spacing drum to the second side of the spacing drum.

In at least some example embodiments, the first conveying path and the second conveying path form a single conveying belt.

In at least some example embodiments, a speed of the first conveying path is the same as a speed of the second conveying path.

In at least some example embodiments, the segments are segments of a filter.

In at least some example embodiments, a system includes a first spacing drum configured to receive at least two first segments per revolution of the drum and configured to release the at least two segments at a first segment-release spacing and a first segment-release speed, the at least two segments at the first segment-release spacing being a first combined segment and a second spacing drum configured to receive the first combined segment and at least two second segments and configured to release the first combined segment and the at least two second segments at a second segment-release spacing and a second segment-release speed, the at least two segments and the first combined segment at the second segment-release spacing being a second combined segment.

In at least some example embodiments, the system further includes a single wrapper configured to perform a single wrapping of the second combined segment.

In at least some example embodiments, the single wrapper is a garniture.

In at least some example embodiments, the first spacing drum includes radial flight profile including continuous arcs extending from a first side of the first spacing drum to a second side of the first spacing drum.

In at least some example embodiments, the continuous arcs transition the at least two first segments from the first side of the first spacing drum to the second side of the first spacing drum by pushing the at least two first segments as the at least two first segments travel from the first side of the spacing drum to the second side of the spacing drum.

In at least some example embodiments, the second spacing drum is the same as the first spacing drum.

In at least some example embodiments, the first spacing drum is configured to release the at least two first segments at the first segment-release spacing such that the at least two first segments contact each other.

In at least some example embodiments, the second spacing drum is configured to release the first combined segment and the at least two second segments at the second segment-release spacing such that the at least two segments contact each other.

In at least some example embodiments, the first segment-release speed and the second segment-release speed are the same.

In at least some example embodiments, the system further includes a first hopper configured to dispense one of the at least two first segments and a second hopper configured to dispense another of the at least two first segments.

In at least some example embodiments, the system further includes a third hopper configured to dispense one of the at least two second segments and a fourth hopper configured to dispense another of the at least two second segments.

In at least some example embodiments, a method includes establishing a procession of first segments at a first entrance spacing, converting the first entrance spacing to a first exit spacing by passing at least two of the first segments through a first spacing drum to form a first combined segment, establishing a procession of at least two second segments and the first combined segment at a second entrance spacing, converting the second entrance spacing to a second exit spacing by passing the at least two second segments and the first combined segment through a second spacing drum to form a second combined segment and forming the filter using the second combined segment.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1A:
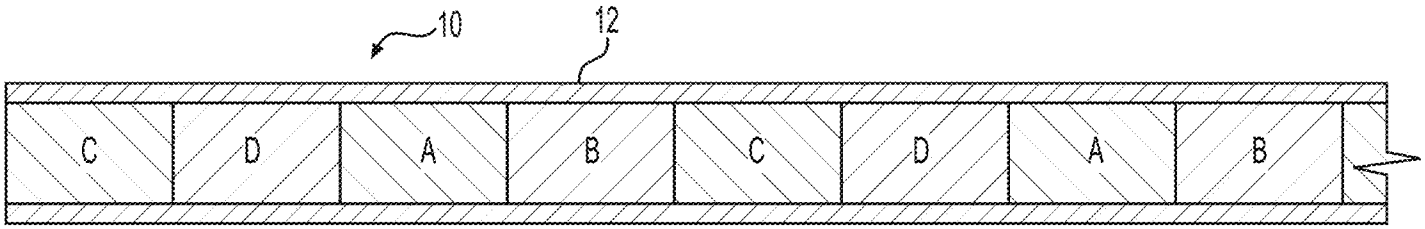
FIG. 1A is cross-section of an example of a rod section that may be produced using some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

Aerosol, vapor and dispersion are terms used interchangeably and are meant to cover any matter generated or output by the devices claimed and equivalents thereof. The pre-aerosol formulation may also be a pre-vapor formulation or a pre-dispersion formulation.

The present disclosure may be used for the manufacture of aril type of rod, such as a filter or rods of fibrous material, and/or any other fibrous material products, such as smoking, heat not burn and other articles that generate, heat, smoke, etc.

For instance, the fibrous material may be a botanical material. The fibrous material is configured to release a compound when heated. For instance, the fibrous material may be plant material such as tobacco. The term "tobacco" includes any tobacco plant material including tobacco leaf, tobacco plug, reconstituted tobacco, compressed tobacco, shaped tobacco, or powder tobacco, and combinations thereof from one or more species of tobacco plants, such as *Nicotiana rustica* and *Nicotiana tabacum*.

In some example embodiments, the tobacco material may include material from any member of the genus *Nicotiana*. In addition, the tobacco material may include a blend of two or more different tobacco varieties. Examples of suitable types of tobacco materials that may be used include, but are not limited to, flue-cured tobacco, Burley tobacco, Dark tobacco, Maryland tobacco, Oriental tobacco, rare tobacco, specialty tobacco, blends thereof, and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass. Furthermore, in some instances, the tobacco material may be mixed and/or combined with at least one of propylene glycol, glycerin, sub-combinations thereof, or combinations thereof.

The fibrous material may also be a naturally occurring constituent of a medicinal plant that has a medically-accepted therapeutic effect. For instance, the medicinal plant may be a cannabis plant, and the compound may be a cannabinoid. Cannabinoids interact with receptors in the body to produce a wide range of effects. As a result, cannabinoids have been used for a variety of medicinal purposes (e.g., treatment of pain, nausea, epilepsy, psychiatric disorders). The fibrous material may include the leaf and/or flower material from one or more species of cannabis plants such as *Cannabis sativa, Cannabis indica*, and *Cannabis ruderalis*. In some instances, the fibrous material is a mixture of 60-80% (e.g., 70%) *Cannabis sativa* and 20-40% (e.g., 30%) *Cannabis indica*.

Examples of cannabinoids include tetrahydrocannabinolic acid (THCA), tetrahydrocannabinol (THC), cannabidiolic acid (CBDA), cannabidiol (CBD), cannabinol (CBN), cannabicyclol (CBL), cannabichromene (CBC), and cannabigerol (CBG). Tetrahydrocannabinolic acid (THCA) is a precursor of tetrahydrocannabinol (THC), while cannabidiolic acid (CBDA) is precursor of cannabidiol (CBD). Tetrahydrocannabinolic acid (THCA) and cannabidiolic acid (CBDA) may be converted to tetrahydrocannabinol (THC) and cannabidiol (CBD), respectively, via heating.

In the past, spacing drums have been constructed to have compound flights, which were in effect a set of flights having a first pitch at the entrance of the spacing drum and a second pitch at the exit of the spacing drum with an abrupt transition therebetween. The abrupt transition may create registration issues, as a segment traveling through the drum guided by a flight may lose contact with the flight at or about the abrupt transition, and/or may move on its own inertia. Such uncontrolled motion may frustrate consistent positioning of the segment as it exits the drum.

Moreover, many linear fed garniture machines have two hoppers. If a combined filter element uses more than two filter segments, multiple combining operations are used.

Multiple combining operations increase the complexity and materials used in generating the combined filter element. The inventors have discovered systems to reduce the number of steps where multiple segments can be combined into a single element, thereby reducing the materials (e.g., paper and glue) used in the combining operation.

In some example embodiments, a single spacing drum may be used to combine three filter segments into a single filter element.

In some example embodiments, two space drums are used to combine four filter segments into a single filter element. A first drum may combine filter segments from two hoppers to form a combined segment and a second drum combines the combined segment with filter segments from two other hoppers.

Figure 1B:
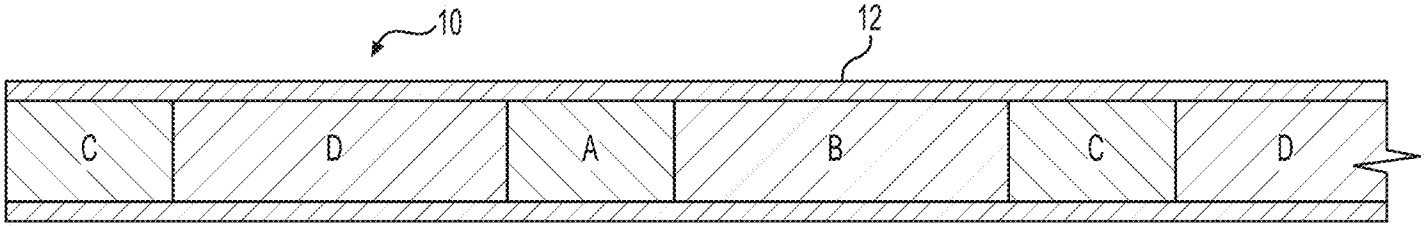
FIG. 1B is cross-section of another example of a rod section that may be produced using some example embodiments.

Referring now to FIGS. 1A and 1B, some example embodiments provide systems and apparatuses for producing rods 10 comprising one, two or more segments. In one example, such as a rod including segments A, B, C and D the segments A, B, C and D may be of a common length (FIG. 1A) or differ in length (FIG. 1B). The segments may be constructed from a common material or differ in composition.

Figure 1C:
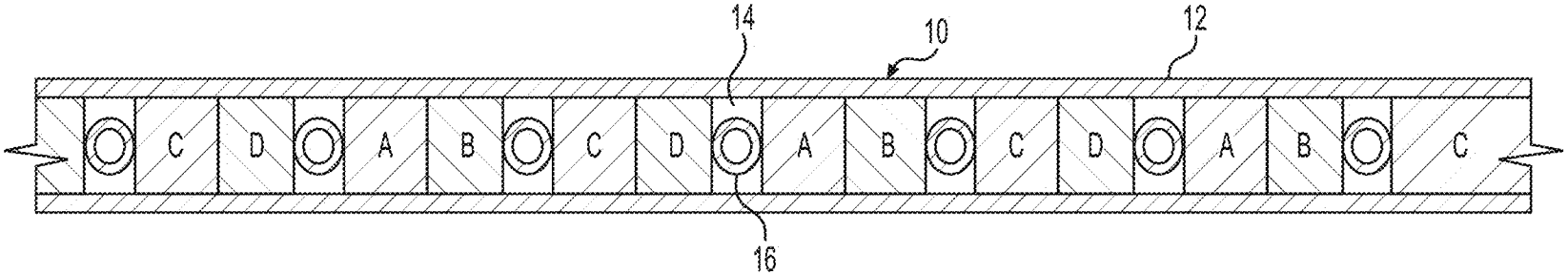
FIG. 1C is cross-section of still another example of a rod section that may be produced using some example embodiments.
Figure 1D:
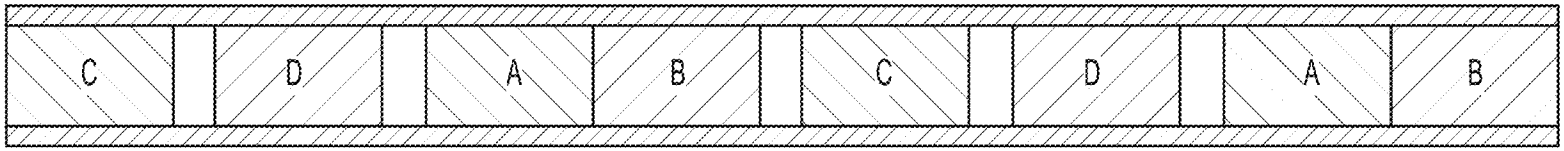
FIG. 1D is cross-section of still another example of a rod section that may be produced using some example embodiments.
Figure 1E:
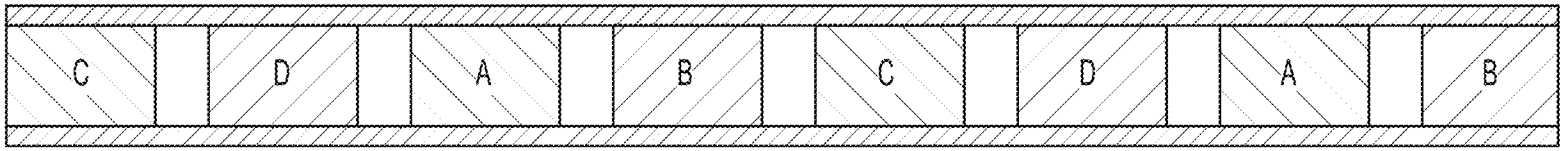
FIG. 1E is cross-section of still another example of a rod section that may be produced using some example embodiments.

Referring to FIGS. 1C-1E, the continuous rod 10 may comprise a repeated pattern of segments (such as A, B, C, D or more) or a repeated pattern of a single segment A and may further comprise spacings 14 provided between one more of the segments as part of the repeated pattern. The rod 10 may further include an element inserted into each of the spaces 14 such as, by way of non-limiting examples, tobacco, tobacco derivatives, a crushable flavor bead 16 or a bed of particles such as particles of an activated carbon or other adsorbent or other aerosol treating or flavoring particles.

Spacing drum embodiments disclosed herein are not limited to use for producing multi-segment rods, and may be used in any manufacturing operations where a spacing drum may be helpful.

Referring now to FIGS. 2A-3B, example embodiments of a machine system 20 may be configured to produce a continuous rod 10 which may be severable into individual rods 24. The machine system 20 may comprise a first segment feeding section 26-1, a second feeding section 26-2 and a rod forming section 28.

The first segment feeding section 26-1 may comprise a first radial profile spacing drum 30-1 according to an example embodiment with one or more radial profile flights 32, a first source 34 of the segments A, a second source 36 of the segments B and an endless feed belt 38-1 (a first endless feed belt). The endless feed belt 38-1 may be directed about a roller 37-1 at a location adjacent the first radial profile spacing drum 30-1. The endless feed belt 38-1 may receive the individual segments A and B from the first and second sources 34 and 36, respectively, in an alternating relation so as to establish a first, feed procession 40 of filter segments A, B, which may move at the speed of endless feed belt 38-1 ("$v_1$").

In some example embodiments, the first and second sources 34 and 36 of individual segments may comprise first and second hopper sections 200-1, 200-2. The hopper sections 200-1, 200-2 may include a hopper 202, a plurality of knives 204, which may cooperate with a knife drum 206. The output of segments A, B from the hoppers 202, respectively, may be directed onto the endless feed belt 38-1 by operation of metering wheels 208. The particulars of the construction and operation of the first and second hopper sections 200-1 and 200-2 are familiar to those of ordinary skill in the art.

Referring back to the example embodiments shown in FIGS. 2A-3B, the phase of the output of segments A, B from the first and second sources 34 and 36, respectively, may be adjusted to adjust their relative positions along the endless feed belt 38-1. For example, the phase relation may be selected to place each segment B closer to the segment A that precedes it or instead place each segment B closer to the trailing segment A that may be located behind it.

Figure 2A:
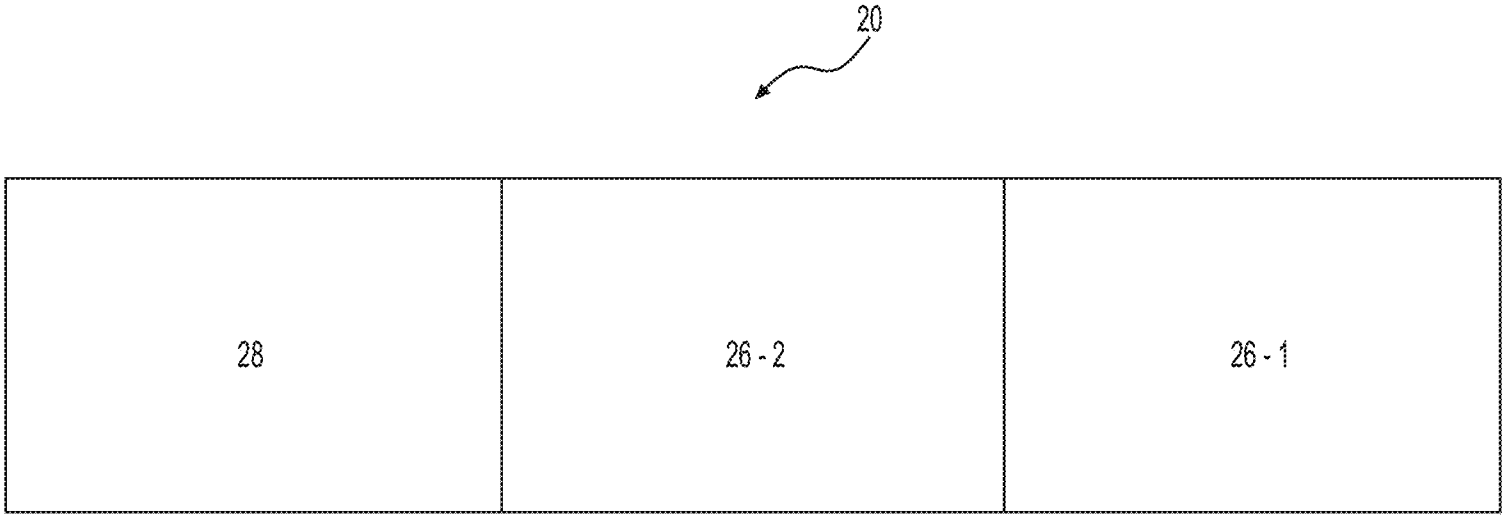
FIG. 2A illustrates a system layout in accordance with some example embodiments.
Figure 2B:
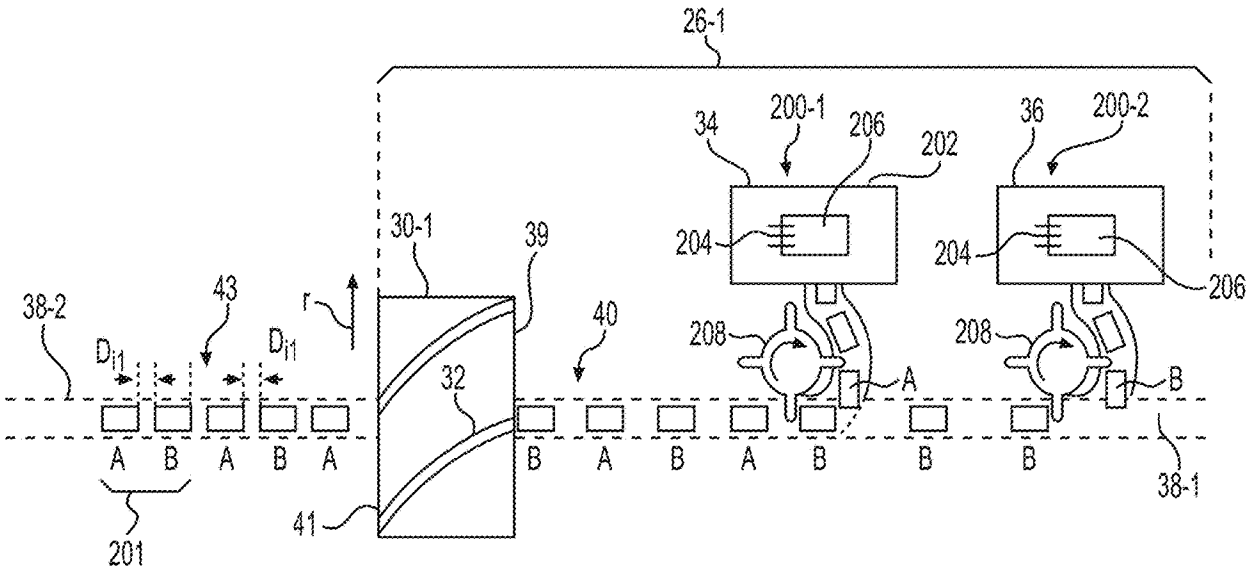
FIG. 2B is a top view representation of a section of the system layout of FIG. 2A in accordance with some example embodiments.
Figure 2C:
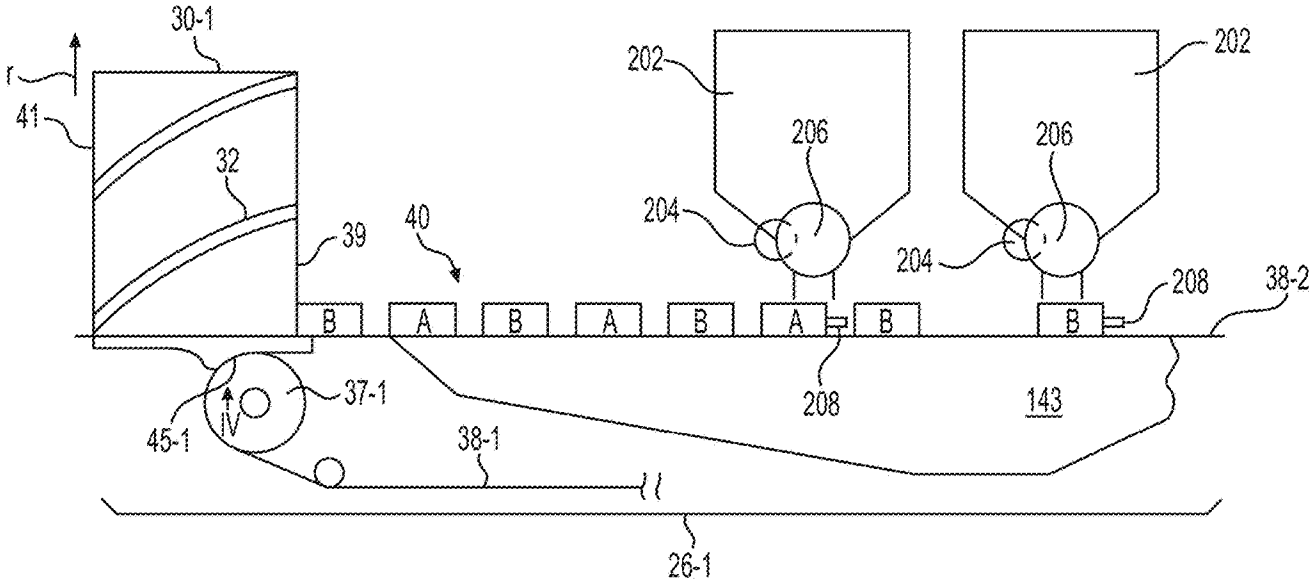
FIG. 2C is a side view representation of the section shown in FIG. 2B in accordance with some example embodiments.

As shown in FIG. 2C, the first radial profile spacing drum 30-1 may cooperate with a bridge 45-1 that may be configured to provide support and grooved guidance for the segments A, B as they are moved linearly beyond the operative end of the endless feed belt 38-1 and into the first radial profile spacing drum 30-1, whereupon a radial profile flight 32 may cut across empty space behind a segment and progress into contact with a trailing end portion of the segment to continuously push the segment toward the exit end 41 of the first radial profile spacing drum 30-1.

The endless feed belt 38-1 may move the feed procession 40 toward the entrance end 39 of the first radial profile spacing drum 30-1 at the speed $v_1$.

In an example embodiment, as segments A and B pass through the first radial profile spacing drum 30-1, segments A, B may be continuously decelerated (or accelerated) within the first radial profile spacing drum 30-1 of the forming section 26-1 and transformed into pairs having a desired spacing between pairs 201 of the segments A, B such that a spacing between segments A, B in a same pair is $Di_1$.

Moreover, the first radial profile spacing drum 30-1 rotates such that a lateral speed of the segments A, B as they exit the first radial profile spacing drum 30-1 matches the speed of an endless belt 38-2.

Each pair 201 may also be referred to as a combined segment. In some example embodiments, the spacing $Di_1$ is zero (i.e., one segment A and one segment B in a same pair abut each other). The spacing between segments can be increased or decreased based on product development requirements.

The first radial profile spacing drum 30-1 may discharge the individual segments A, B at the speed $v_1$ which may match that of the belt speed of an endless feed belt 38-2 (a second endless feed belt) of the second feeding section 26-2. In some example embodiments, the endless feed belts 38-1 and 38-2 are a single endless feed belt. Accordingly, the first radial profile spacing drum 30-1 may establish a second, output procession of segments 43 with a different spacing between segments compared to the first procession of segments 40 at the entrance end 39.

Figure 2D:
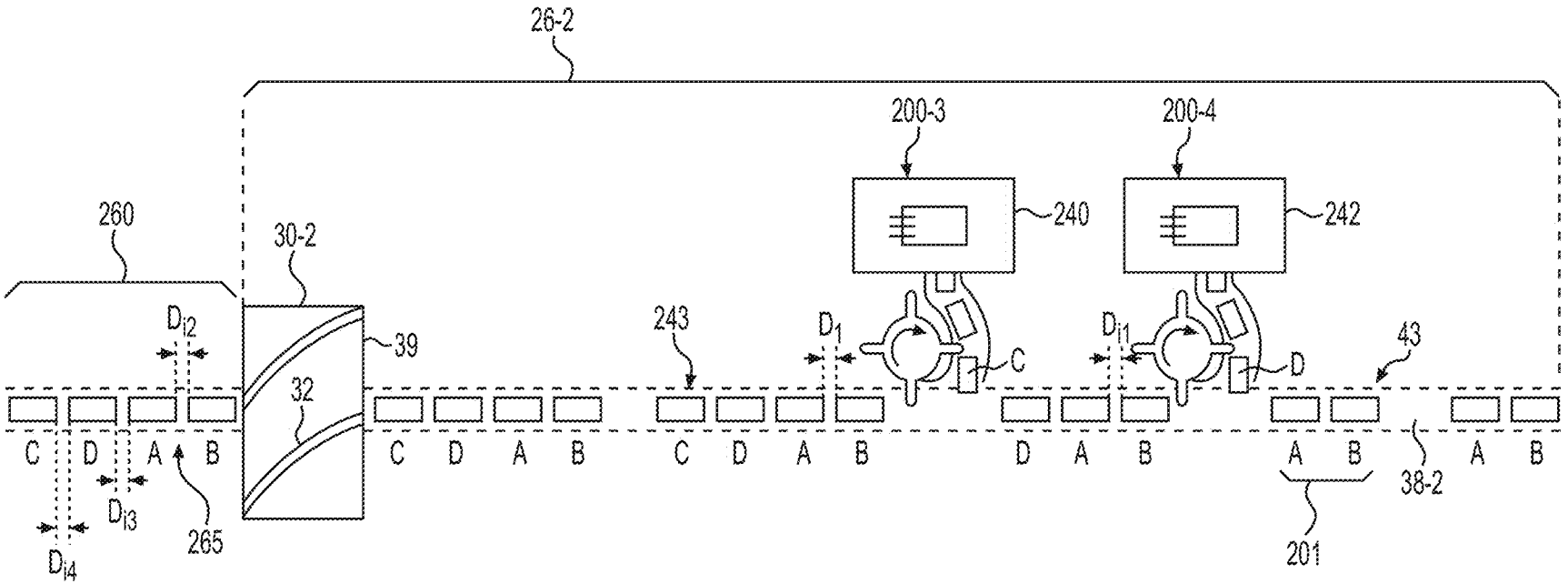
FIG. 2D is a top view representation of another section of the system layout of FIG. 2A in accordance with some example embodiments.

Referring now to FIG. 2D, the second segment feeding section 26-2 may comprise a second radial profile spacing drum 30-2. In some example embodiments, the second radial profile spacing drum 30-2 may be the same as the first radial profile spacing drum 30-1. In other example embodiments, the second radial profile spacing drum 30-2 may be different than the first radial profile spacing drum 30-1. In example embodiments where the second radial profile spacing drum 30-2 are different than the first radial profile spacing drum 30-1, the difference in profiles causes a difference in spacing between segments, but does not cause a difference in ejection speed between the first radial profile spacing drum 30-1 and the second radial profile spacing drum 30-2.

The second segment feeding section 26-2 further includes a third source 240 of the segments C, a fourth source 242 of the segments D and the endless feed belt 38-2.

The endless feed belt 38-2 may be directed about a roller 37-2 at a location adjacent the second radial profile spacing drum 30-2. The endless feed belt 38-2 may receive the individual segments C and D from the third and fourth sources 240 and 242, respectively, in a relation with the second procession 43 of combined filter segments A, B so as to establish a third feed procession 243 of filter segments C, D, A, B, which may move at the speed of endless feed belt 38-2 ("$v_1$"). Moreover, in other example embodiments, the third feed procession 243 may include filter segments A, B, C and D (e.g., arranged in an order of C, D, A and B).

In some example embodiments, the third and fourth sources 240 and 242 of individual segments may comprise third and fourth hopper sections 200-3, 200-4. The third and fourth hopper sections 200-3 and 200-4 may be the same as the hopper sections 200-1 and 200-2.

If it were desired to include additional segments, then additional hopper sections or more could be arranged in like manner.

The phase of the output of segments C, D from the third and fourth sources 240 and 242, respectively, may be adjusted to adjust their relative positions along the endless feed belt 38-2. For example, the phase relation may be selected to place each segment C and D closer to the leading combined segment A, B that precedes the segments C and D or instead place each segment C and D closer to the trailing combined segment A, B that may be located behind it.

Moreover, each of the first radial profile spacing drum 30-1 and the second radial profile spacing drum 30-2 may rotate counter clockwise to decrease separation or rotate forward to increase separation.

Figure 3A:
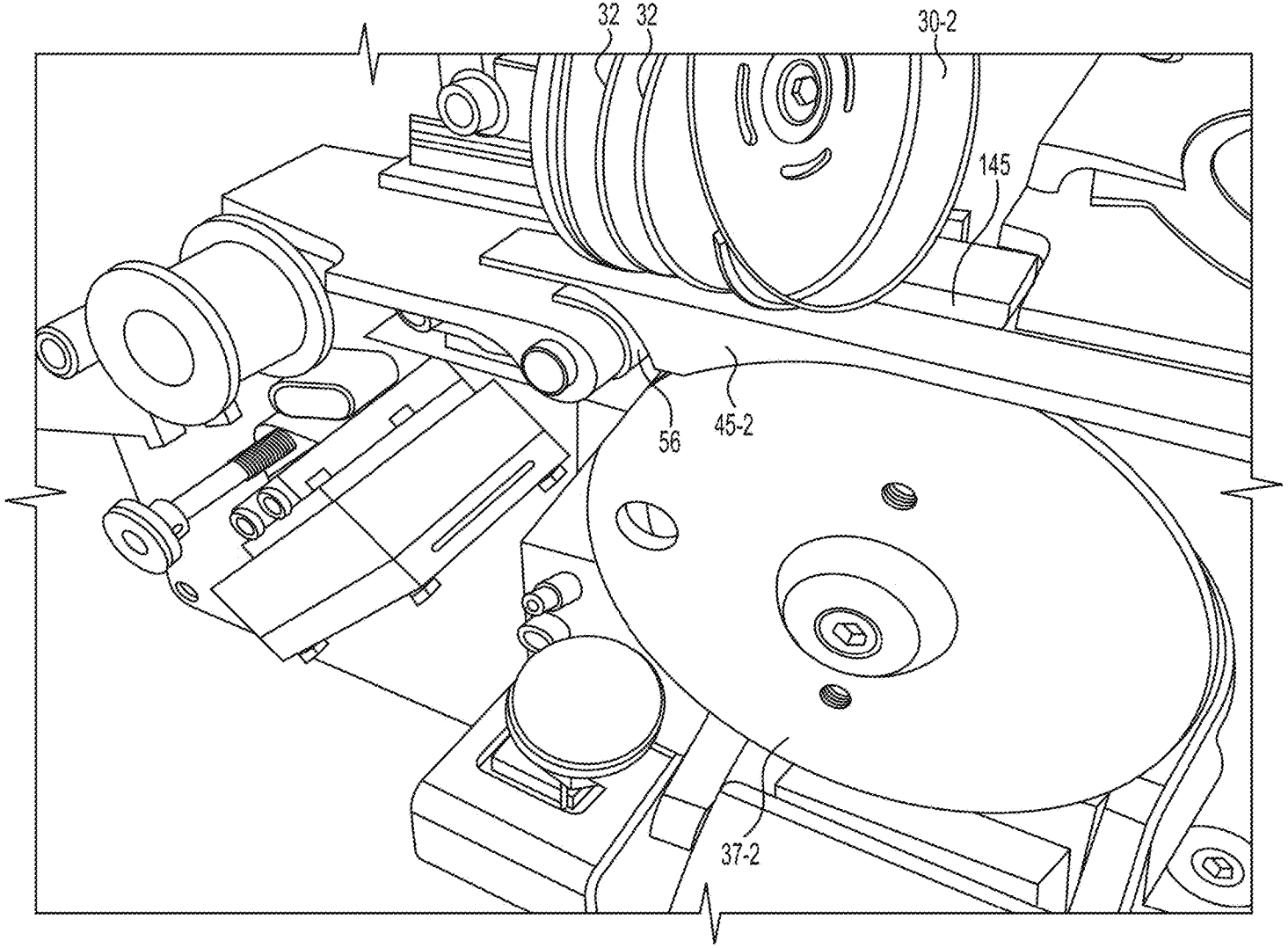
FIG. 3A is a detail perspective view at a location of a spacing drum and bridge section of a machine layout such as shown in FIGS. 2 and 3, in accordance with some example embodiments.
Figure 3B:
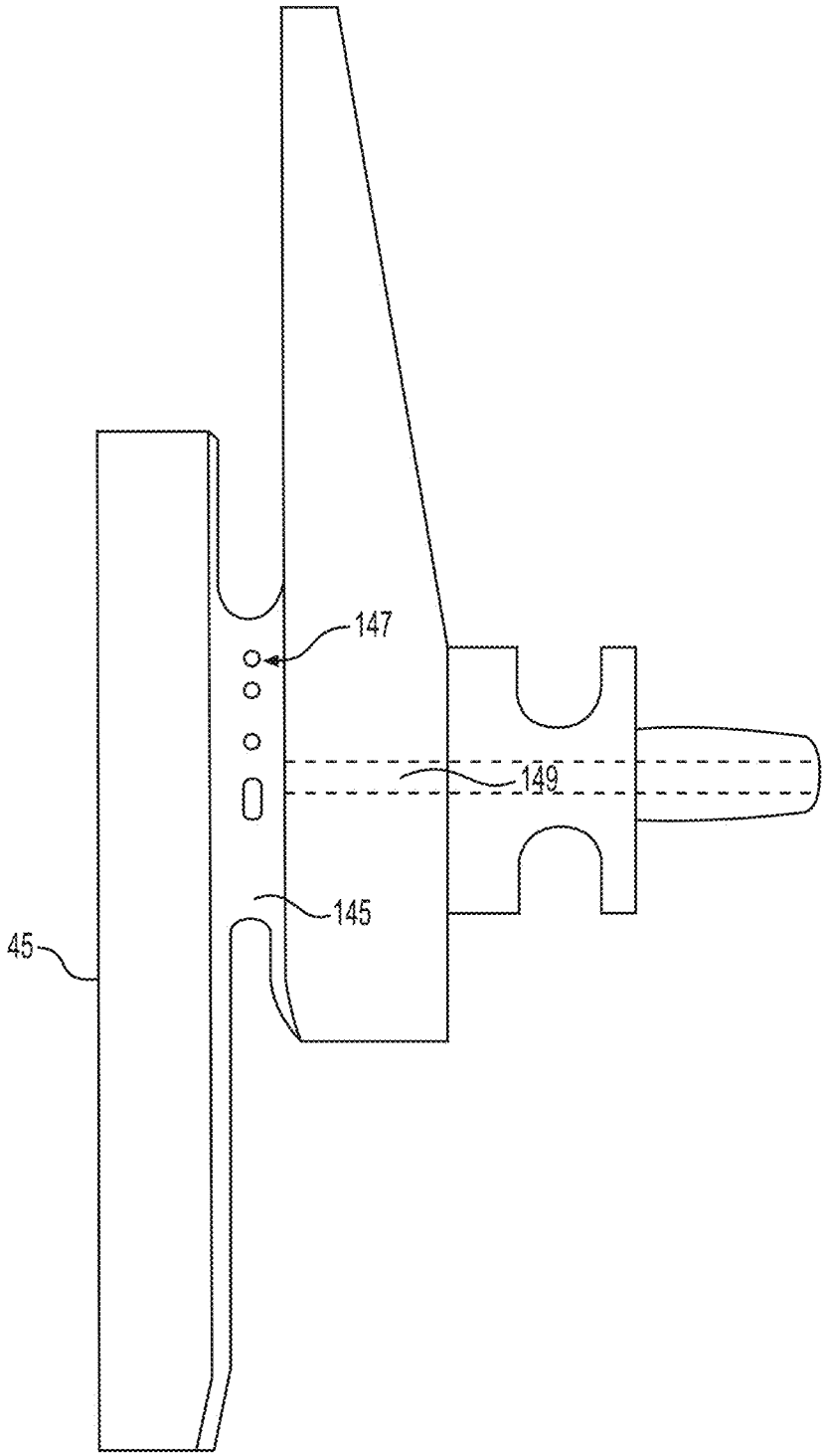
FIG. 3B is a top planar view of a bridge piece suitable for use in a bridge section shown in FIGS. 3A-3B in accordance with some example embodiments.

Referring to FIGS. 3A and 3B, in various embodiments, a bridge 45-2 may also extend beneath the second radial profile spacing drum 30-2 and may be provided with a groove 145 of sufficient depth to counteract any tendency a radial profile flight 32 to displace segments A, B, C and D laterally of the intended linear path. A structure of the bridge 45-2 extending beneath the second radial profile spacing drum 30-2 may be the arrangement.

In some embodiments, the groove 145 may include a plurality of vacuum ports 147 that communicate with a source of vacuum through an internal passage 149 in the bridge 45-2. The placement of the vacuum ports 147 and the draw of vacuum may be arranged to help maintain a desired, relative positioning (registration) of the segments A, B, C and D as they cross the bridge 45-2 or portions thereof. The bridge 45-2 prevents segments A, B, C and D from being disengaged from the second radial profile spacing drum 30-2. It should be understood that the bridge 45-1 and the bridge 45-2 may have the same structure. Thus, a separate illustration of the bridge 45-1 is not illustrated.

In some example embodiments, a vacuum plenum 143 may be disposed beneath the endless feed belts 38-1 and 38-2 to help maintain the segments A, B, C and D at their spaced locations along the endless feed belts 38-1 and 38-2.

The endless feed belt 38-1 may move the feed procession 40 toward the entrance end 39 of the radial profile spacing drum 30-1 at the speed $v_1$ and the endless feed belt 38-2 may move the feed procession 243 toward the entrance end 39 of the radial profile spacing drum 30-2.

In an example embodiment, as the combined segment 201 and segments C and D pass through the second radial profile spacing drum 30-2, the combined segment 201 and segments C and D may be continuously decelerated and maintain contact with radial profile flights 32, respectively. The combined segment 201 and segments C and D may be transformed into a desired sequence for a combined segment 260 upon exiting the second radial profile spacing drum 30-2 and desired spacings between segments C, D, A and B in the combined segment 260 such that a spacing between segments D and A in the combined segment 260 is $Di_3$ and a spacing between elements C and D in the combined segment 260 is $Di_4$. In some example embodiments, the spacings $Di_3$ and $Di_4$ are zero (i.e., one segment C and one segment D in a same combined segment 260 abut each other and the one segment D and one segment A in the same combined segment 260 abut each other).

Figure 2E:
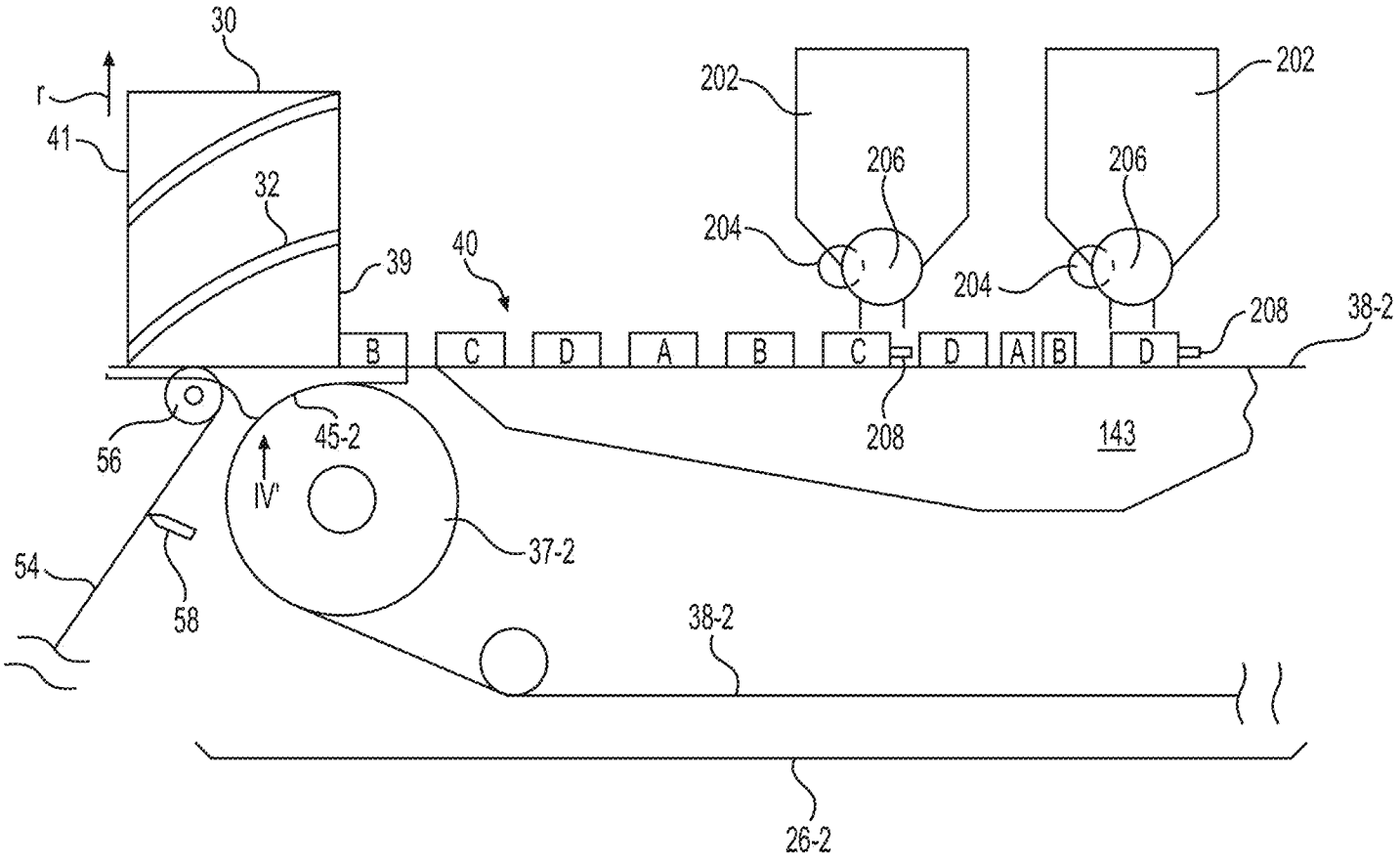
FIG. 2E is a side view representation of the section shown in FIG. 2D in accordance with some example embodiments.
Figure 2F:
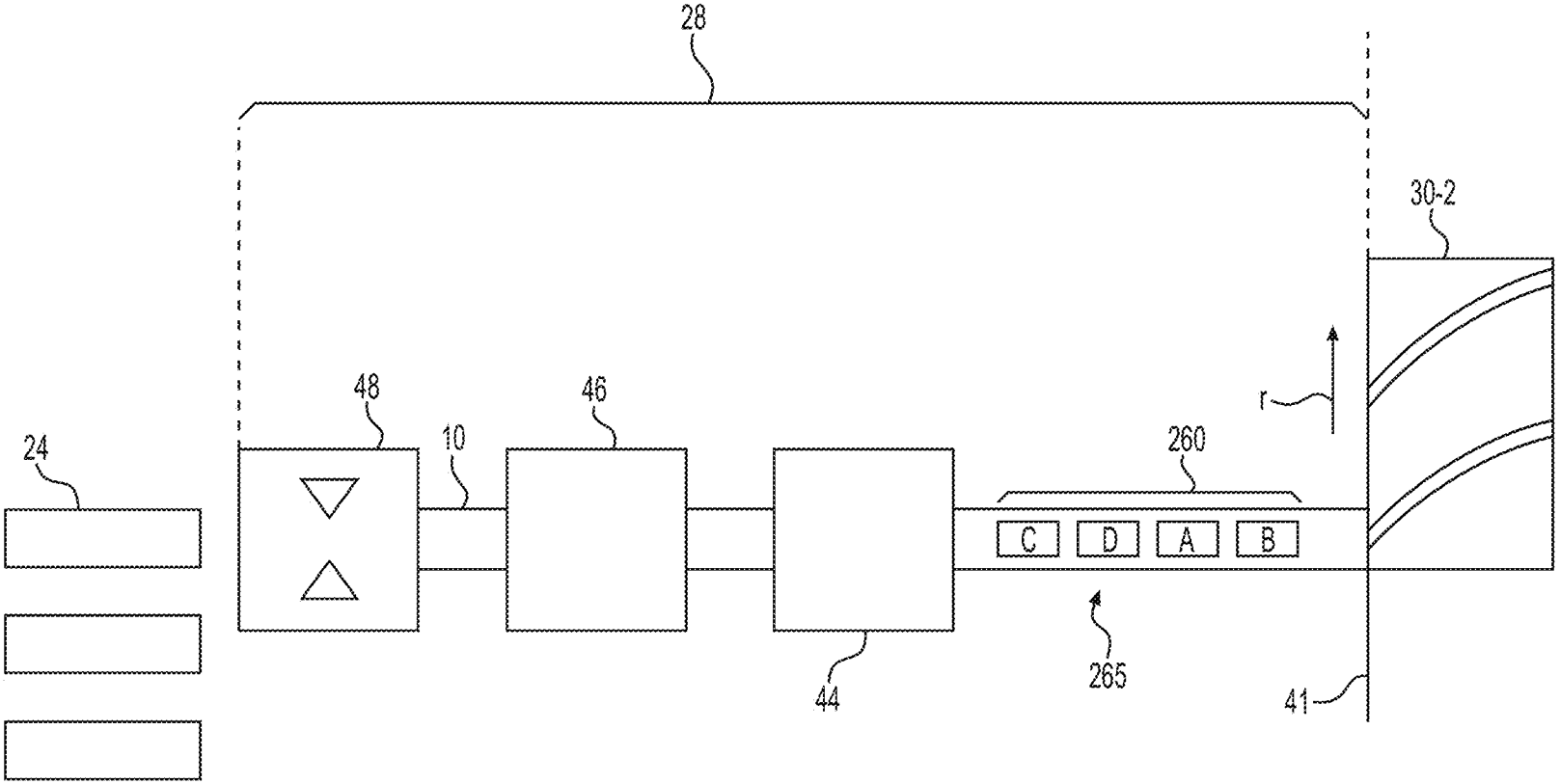
FIG. 2F is a top view representation of another section of the system layout of FIG. 2A in accordance with some example embodiments.
Figure 2G:
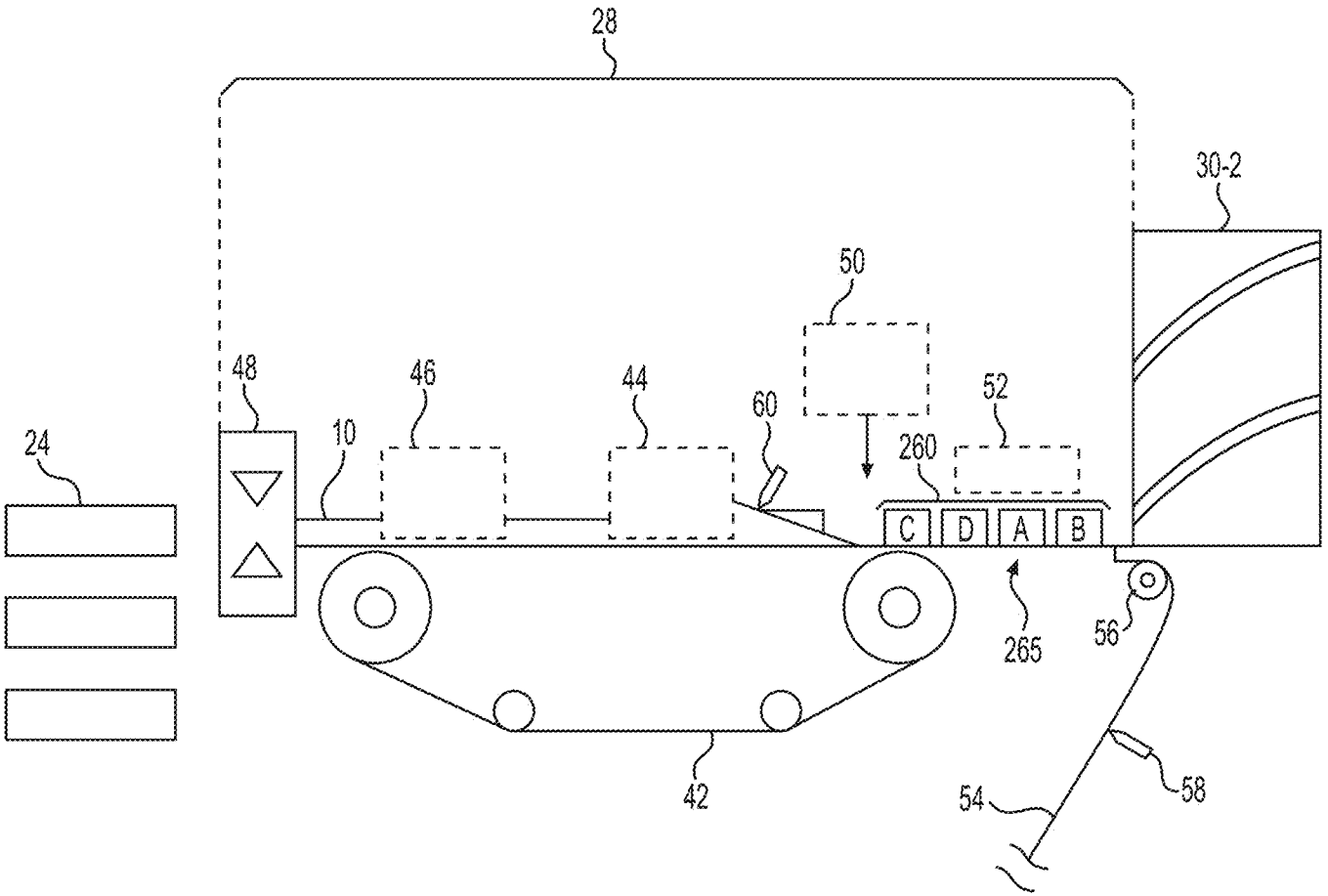
FIG. 2G is a side view representation of the section shown in FIG. 2F in accordance with some example embodiments.

Moreover, the second radial profile spacing drum 30-2 rotates such that a lateral speed of the segments C, D, A, B as they exit the second radial profile spacing drum 30-2 matches the speed of an endless tube belt 42 (shown in FIG. 2G).

Accordingly, the second radial profile spacing drum 30-2 may establish a fourth output procession of segments 265 with a different spacing between segments, and/or different speed of the segments, compared to the third procession of segments 243 at the entrance end 39 of the second radial profile spacing drum 30-2.

In certain example embodiments, the speed $v_1$ of the third procession of segments 243 may be greater than a speed $v_2$ of the fourth procession of segments 265, wherein the second radial profile spacing drum 30-2 may be configured to lower the speed of the segments as the segments progress through the second radial profile spacing drum 30-2. It is to be realized that in other embodiments the relative speeds of first, second, third and fourth procession of segments may differ from that of the non-limiting example embodiment presented herein (for example, in certain embodiments the speeds $v_1$ and $v_2$ may be the same, and in certain embodiments $v_2$ may lower than $v_1$); and that the relative speeds, rod construction and other details of the example embodiment are chosen only for purposes of facilitating an understanding of the teachings herein and not as a limitation upon the applicability of those teachings to other embodiments.

Referring to FIGS. 2F-2G, the rod forming section 28 may comprise the endless tube belt 42 (garniture belt), a garniture 44, a glue setting station 46 and a cutter 48. The endless garniture belt 42 of the rod forming section 28 may be configured to draw a continuous ribbon of web 54 about a roller 56 positioned adjacent the exit end 41 of the second radial profile spacing drum 30-2 such that as the segments C, D, A, B may be pushed out from the exit end 41 of the second radial profile spacing drum 30-2 to form the fourth procession of segments 265, each combined segment 260 may be positioned upon the continuous ribbon of web 54 and may be drawn with it into and though the garniture 44, whereupon the web 54 may be wrapped about and securely glued about the each combined segment 260 including segments C, D, A and B.

In some embodiments, the rod forming section 28 may further comprise a suitable glue applicator 58 that may be operative at a location upstream of the roller 56 to help maintain the relative placements of the segments C, D, A, B and a second, suitable glue applicator 60 which may be operative at or about the garniture 44 to seal the seam of the continuous filter rod 10 produced by garniture 44. The freshly formed, continuous filter rod 10 may be drawn through a suitable glue setting station 46 and then through a suitable cutter 48, where the continuous rod 10 may be repetitively severed into the desired multi or single-component rods 24, with each rod including a combined segment 260 of segments C, D, A and B.

For production of certain filter rods 24, the rod forming section 28 may further comprise an insertion device 50 for inserting activated carbon, adsorbents, flavorants, beads or the like. Examples of such devices may be found in U.S. Pat. No. 4,411,640 to Hall; U.S. Pat. No. 5,875,824 to Atwell et al., and U.S. Pat. No. 5,542,901 to Atwell et al., the entire contents of each of which are hereby incorporated by reference.

Figure 4A:
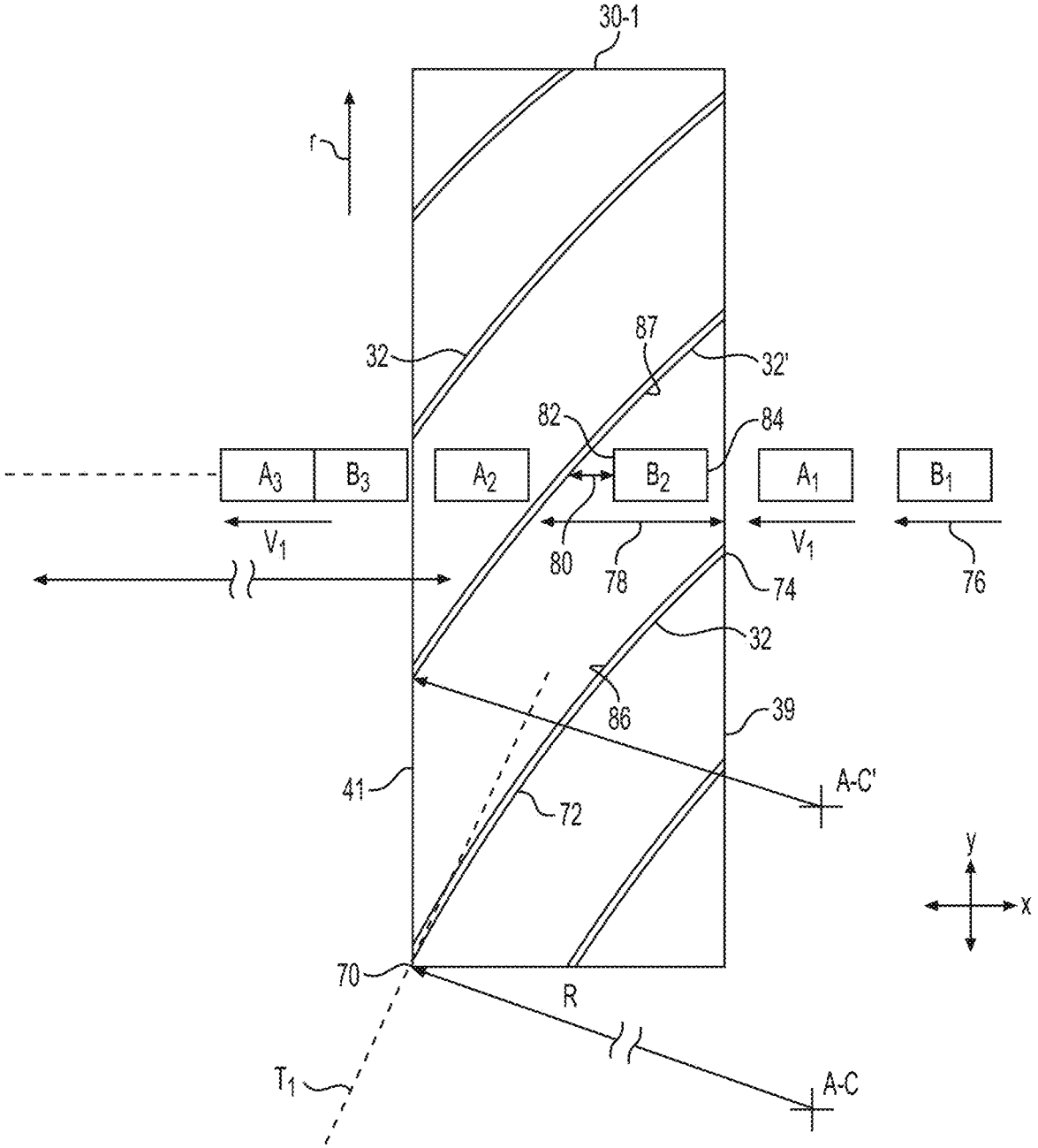
FIG. 4A is a representation of a spacing drum as viewed in the direction of arrow IV in FIG. 2C, according to some example embodiments.

Referring now to FIG. 4A, in some example embodiments, the first radial profile spacing drum 30-1 may comprise a radial profile flight 32, which at the exit end 41 of the first radial profile spacing drum 30-1 may define a tangent $T_1$, by which at the rotational speed of the first radial profile spacing drum 30-1, the flight 32 may impart at the drum exit 41, a velocity $v_1$ to a filter segment (A or B). The radial profile flight 32 may be defined by a radius R which may pass through the point of tangency 70 at the exit end 41 of the drum 30 and which may describe a radial profile arc 72 that may terminate at a location 74 adjacent the entrance end 39 of the first radial profile spacing drum 30-1. The radius R may rotate about an arc center A-C. The direction of rotation of the example first radial profile spacing drum 30-1 may be in the direction of an arrow r in FIG. 4A (also shown in FIGS. 2B and 2C).

In certain example embodiments, the first radial profile spacing drum 30-1 may include multiple radial profile flights 32, each defined by the same radius R, but each rotating about a different arc center A-C. In certain example embodiments, the arc centers A-C of the different radial profile flights 32 may be located in the same x location, but in a different y location (the descriptions in this paragraph assume a flat view of the first radial profile spacing drum 30-1 as shown in FIG. 4A, and that the page defines an x-direction in the horizontal direction of the page, and a y-direction in the vertical direction of the page). In certain example embodiments, one or more different y locations of the arc centers A-C of different flights may be separated from each other by the same distance in the y-direction. In certain example embodiments, the y locations of the arc centers A-C of all the different flights may be separated from each other by the same distance in the y-direction. In certain example embodiments, one or more different y locations of the arc centers A-C of different flights may be separated from each other by different distances in the y-direction. In certain example embodiments, the distance in the y-direction between the center of two different flights 32 (i.e., ignoring the thickness of the flights) at drum exit end 41 is the same than at drum entrance end 39. In certain example embodiments, the distance in the x-direction between a flight 32 and the flight preceding it at entrance 39 is greater than the distance in the x-direction between said flight 32 and the flight trailing it at exit 41.

In certain example embodiments, a radius R of a flight 32 may rotate about an arc center (A-C) that may be offset from segment path 76 (beneath the spacing drum 30) both in the sense of being to one side of the spacing drum 30 (and the segment path 76) and upstream of the spacing drum 30 in the sense of the movement of segments along the segment path 76.

In an example embodiment, at the entrance end 39 of the first radial profile spacing drum 30-1, segments A1 and B1 may be moving at a speed v1. As each of the segments A1 and B1 enter the entrance end 39 of the spacing drum 30, they may tend to position themselves, upon their own inertia, within an axial space 78 between an immediate radial flight 32 and a preceding flight 32'. The segment B2 in FIG. 4A may be immediately upstream of the first segment A1 and may be positioned as just described, wherein a clearance 80 may exist between a leading end portion 82 of the segment B2 and the preceding flight 32'. Upon entry into the entrance end 39 of the first radial profile spacing drum 30-1, the immediate radial profile flight 32 may contact the downstream end portion 84 of the segment B2 to push the segment B2 along the segment path 76 (guided by bridge 45-1 as described above) to the exit end 41 of the spacing drum 30. In some example embodiments, because the immediate flight 32 has a radial profile as previously described, the segment B2 may be in continuous contact with the leading side 86 of the radial profile flight 32 as it progresses from the entrance end 39 to the exit end 41 of the first radial profile spacing drum 30-1, during which time the radial profile flight 32 may cause the segment to continuously decelerate from the speed v1 at the entrance end 39.

As should be understood, the segment may then increase speed to exit at the speed $v_1$ due to the flight design and flight velocity (flight velocity (distance flute travels per 360 degrees rotation)).

In certain example embodiments, at the exit end 41 of the first radial profile spacing drum 30-1, exiting segments (such as $B_3$ in FIG. 4A) may be positioned in an abutting, end-to-end relation to an immediately preceding exiting segment (such as $A_3$ in FIG. 4A), or in another desired spacing (e.g., 1 mm. gap, 3 mm. gap, 5 mm. gap, 1 cm. gap, or other, etc.).

In other words, example embodiments of the first radial profile spacing drum 30-1 may help control the exiting speed of exiting segments, and/or may help control the exiting position of exiting segments relative to other exiting segments. In certain example embodiments, where the y locations of the arc centers A-C of all the different flights are separated from each other by the same distance in the y-direction as described above, exiting segments may be separated from each other by approximately the same distance (or no distance). In certain example embodiments, where one or more different y locations of the arc centers A-C of different flights may be separated from each other by different distances in the y-direction as described above, exiting segments may be separated from each other by different distances. Exiting arc centers are the same as entry arc centers for each individual flight. As stated above, each flight has its own arc center in the "Y" direction.

In certain embodiments, a leading side 86 of the radial profile flight 32 will generally maintain contact with trailing end portion 84 of the segment $B_2$ during its transit across the first radial profile spacing drum 30-1, preventing or minimizing registration issues that may occur with existing spacing drums that have an abrupt transition in the pitch of the flights (e.g., the disclosed arrangement prevents or minimizes movement along the segment path 76 without the registering/controlling effect of positive contact with the leading edge 86 of the radial profile flight 32). Impingement of segment $B_2$ upon other surfaces such as the trailing surface 87 of the immediately preceding flight 32' may also be reduced or prevented. In some example embodiments, accurate and consistent placing of exiting segments at the exit 41 of the first radial profile spacing drum 30-1 may be enhanced.

Figure 4B:
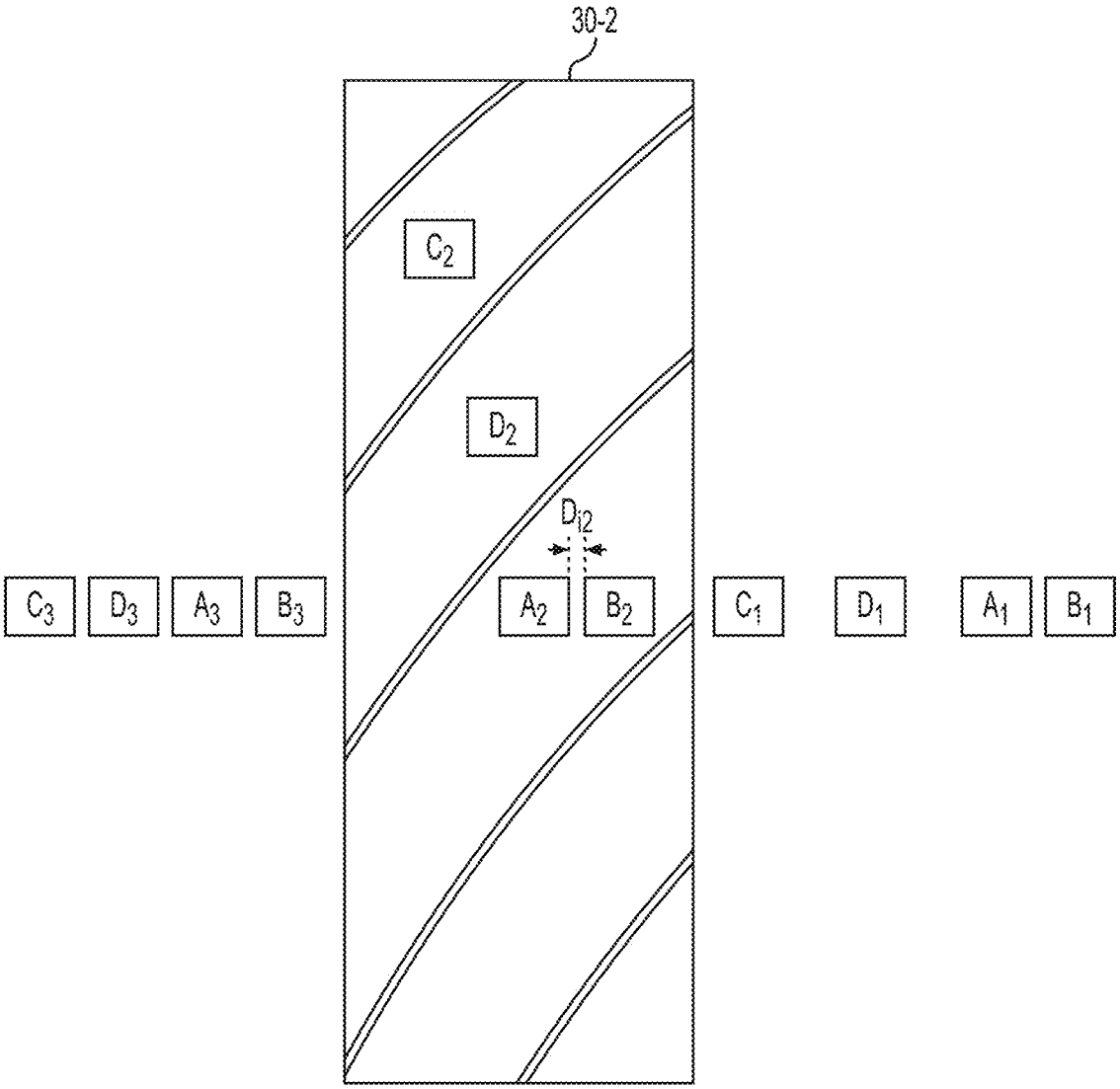
FIG. 4B is a representation of a spacing drum as viewed in the direction of arrow IV' in FIG. 2E, according to some example embodiments.

FIG. 4B is a representation of the second radial profile spacing drum 30-2 as viewed in the direction of arrow IV' in FIG. 2E, according to an example embodiment.

As shown in FIG. 4B, segments $A_2$ and $B_2$ are in a flight together. The distance between the segments $A_2$ and $B_2$ is $Di_2$. In some example embodiments, the distance $Di_2$ is the same as the distance $Di_1$. In some example embodiments, both the distance $Di_2$ and the distance $Di_1$ are zero. For example, when two or more segments are driven/pushed by a single flight the distance between the segments may be zero. The segments $C_2$ and $D_2$ may be in different flights.

Figure 4C:
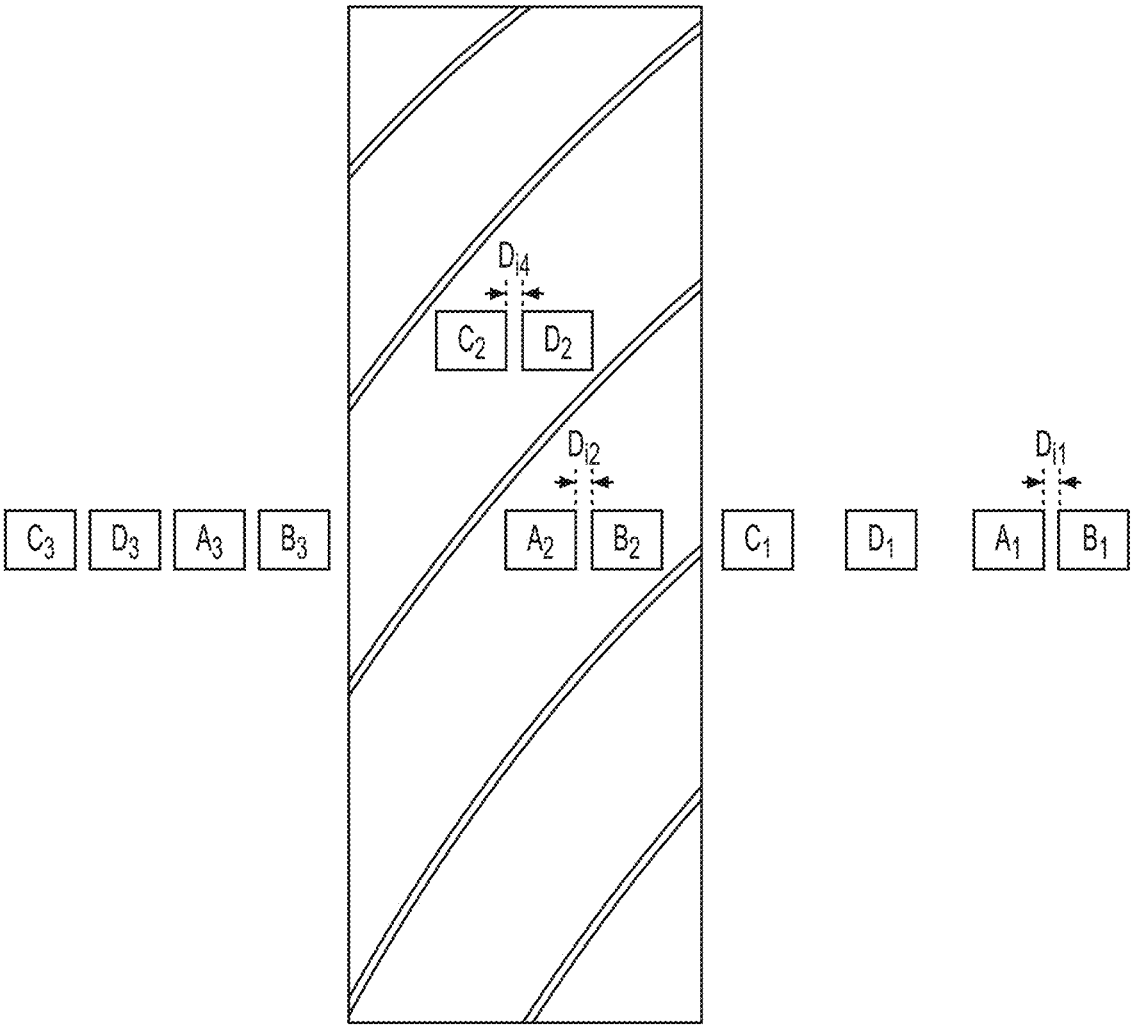
FIG. 4C is a representation of the spacing drum as viewed in the direction of arrow IV' in FIG. 2E, according to some example embodiments.

FIG. 4C is another representation of the second radial profile spacing drum 30-2 as viewed in the direction of arrow IV' in FIG. 2E, according to an example embodiment.

As shown in FIG. 4C, segments $A_2$ and $B_2$ are in a flight together. The distance between the segments $A_2$ and $B_2$ is $Di_2$. Moreover, the segments $C_2$ and $D_2$ may be in a same flight. The distance between the segments $C_2$ and $D_2$ is $Di_4$. In some example embodiments, the distance $Di_4$ is zero.

The speed of the belt 38-2 and the rotational speed of the drum 30-2 determine which of segments $A_2$, $B_2$, $C_2$ and $D_2$ are placed which flights. A geared relationship exists between the second radial profile spacing drum 30-2 and hoppers exist such that for one half a rotation (180 degrees) two flutes of the second radial profile spacing drum 30-2 may rotate and each hopper (including first and second hoppers) have a dispersing cycle which can be one segment, two segments, three segments, etc.

A Method of Determining the Radius R and the Radial Profile Flight

The following provides an example of a geometrical determination of the aforementioned radius R and how it may be applied to establish an array of radial profile flights 32 on a radial profile spacing drum 30 (e.g., the first radial spacing drum 30-1 and the second radial profile spacing drum 30-2) according to an example embodiment.

Figure 5:
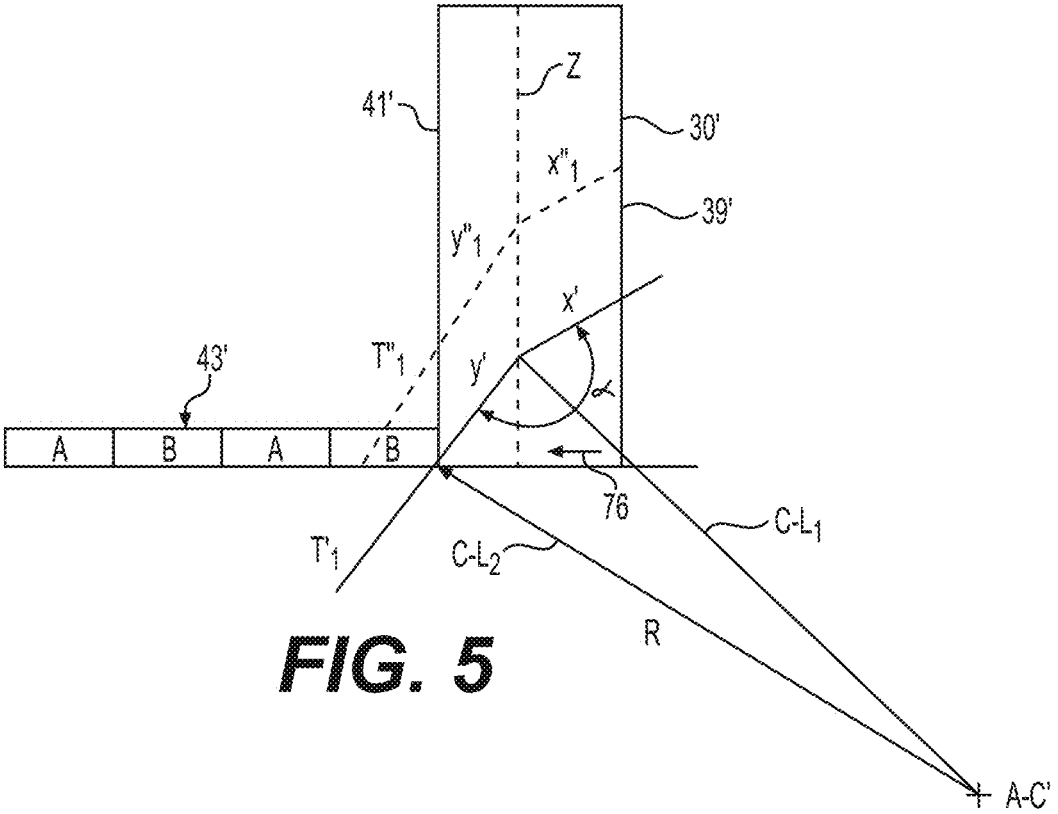
FIG. 5 is a geometric representation of a method of determining an arc-center and/or a radius for a radial profile flight, in accordance with some example embodiments.

Referring now to FIG. 5, the determination may start with generation of a planar geometrical representation 30' ("flat view") of the outer periphery of a spacing drum 30 according to an example embodiment. The planar drum representation 30' may have an elongate rectangular form whose longer edges 39', 41' may correspond with the entrance and exit ends 39, 41, respectively, of the radial profile spacing drum 30. Adjacent the exit end 41', a representation of repeated pattern of segments 43' is shown, which in this example may be a set of four segments (A, B, A, B). In this example, the segments A, B may be of equal length and abutting, but in other embodiments, the segments may differ in length and/or may differ in numbers, some or all may be spaced apart by a plurality of spacings 14 or some or all may be abutting with essentially no spacing between each other and/or some or all may comprise different material such as a filter material and or a tobacco material.

Where the most upstream segment (that being segment B to in FIG. 5) exits the planar drum representation 30', a tangent $T'_1$ may be drawn, based on the same factors used in determining tangent $T_1$ described with reference to FIG. 4A, namely the rotational speed of the drum 30 and the desired exit speed $v_1$. This straight line $T'_1$ may be also geometrically representative of a hypothetical, straight-lined, exit flight which at the rotational speed of the drum 30 would move a segment out from the exit 41' of the drum 30' at the desired exit speed $v_1$.

At the entrance end 39', another inclined line x' may be drawn whose inclination may be such that it represents a hypothetical, straight-lined, entrance flight, which would at the rotational speed of the drum 30 enable the drum 30' to receive at the entrance end 39' a segment at entrance speed $v_1$. In certain example embodiments, the procession 40 of segments (A, B) approaching the entrance end 39' of the spacing drum 30' may have a greater speed and spacing than that that of the procession 43' at the exit 41'. Accordingly, the line x' may be less inclined relative to the segment path 76' than the tangent line $T'_1$ and may be representative of a hypothetical, straight-lined, entrance flight having a pitch greater than the pitch of the hypothetical straight-lined, exit flight that may be represented by the tangent line $T'_1$.

In some example embodiments, a point of intersection y' between the hypothetical, straight-line, exit flight $T'_1$ and the hypothetical, straight-line, entrance flight x' may be arranged such that a greater portion of the axial extent of the planar drum form 30' (in the directional sense of the segment path 76') may be allocated to the hypothetical, straight-line, entrance flight x' and a lesser portion to the hypothetical, straight-line, exit flight $T'_1$. For example, in a non-limiting example embodiment, one-third of the axial extent may be longitudinally allocated to the hypothetical, straight-line, entrance flight $T'_1$ and two-thirds of the axial extent may be longitudinally allocated to the hypothetical, straight-line, entrance flight x'. Such an allocation may be represented by a vertical line z in FIG. 5 and may differ from one embodiment to another.

Upon resolving a point of intersection y' between the hypothetical, straight-line, exit flight $T'_1$ and the hypothetical, straight-line, entrance flight x', an angle $\alpha$ between the two at the intersection y' may be bisected to resolve a first centering line $C\text{-}L_1$, which typically will project to one-side and upstream in the sense of the segment path 76'.

A second centering line $C\text{-}L_2$ may be projected orthogonally from the hypothetical, straight-line, entrance flight $T'_1$ at the location where the entrance flight $T'_1$ intersects the exit end 41' of the planar spacing drum 30'. Typically, the second centering line $C\text{-}L_2$ may project to one side and upstream of the segment path 76 and intersect the first centering line $C\text{-}L_1$. The intersection of the second centering line $C\text{-}L_2$ and the first centering line $C\text{-}L_1$ may be used as an arc center A-C' for resolving the radius R of the radial profiled flight 32' in an example embodiment.

There is a mathematical relationship between the drum and the garniture belt. For each cycle (one revolution of the cutting device 48) the garniture belt 44 will move a desired distance based on dimensions of a desired product (e.g., desired product could be between 40 mm long to 128 mm long, but not limited too). If the desired output, for example, is 90 mm, an exit flite $T_1$ has a helical motion of 90 mm per 180 degrees of drum rotation, or 180 mm per 360 degrees of drum rotation. The exit flight, $T_1$, is a function of the desired product length. An entrance flight may have a higher helical speed than the exit and it is a function of the product length and individual segment length. In example embodiments, the exit flight $T'_1$ and the hypothetical, straight-line, the entrance flight x', the intersection y' and the first centering line $C\text{-}L_1$ are determined such that the speed after exiting the radial spacing drum matches the speed of the belt 38-1 and 38-2.

Figure 6:
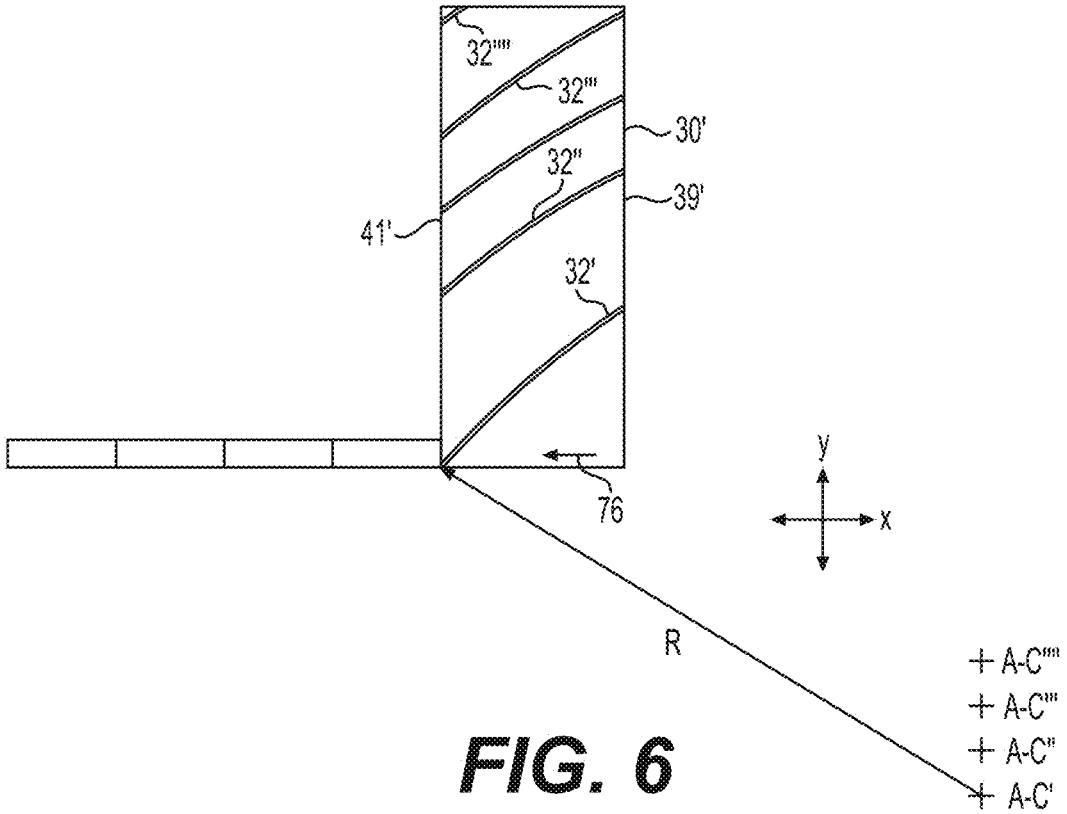
FIG. 6 is a geometrical representation of the method shown in FIG. 5 being applied to create multiple radial profile flights, according to some example embodiments.

Referring now also to FIG. 6, the radius R of the radial profiled flight 32 may be the distance between the previously established arc center A-C' and the location where the hypothetical, straight-line, exit flight T1' intersects the exit end 41' of the spacing drum 30'. The planar layout of the first radial profiled flight 32' may be then projected by rotating the radius R about the arc center A-C' from the exit end 41' to the entrance end 39' of the spacing drum 30'. In some embodiments, such projection may extend between locations at or adjacent the exit end 41' and at or adjacent to the entrance end 39' of the spacing drum 30'. Accordingly, the projection may extend fully across the spacing drum or terminate short of the exit end 41' and/or the entrance end 39'.

In example embodiments, the previously described steps may then be repeated to establish a planar layout of all the radial profiled flights 32', 32", 32''', 32'''', shown in FIG. 6. In doing so, a row of arc centers A-C', A-C", A-C''', A-C'''', etc. may be established in an offset relation to the segment path 76' (to one side and upstream thereof). The planar representation of the desired array of profiled flights 32', 32", 32''', 32'''', etc. may then be converted into a three dimensional layout, which in effect, may be the result of the planar representation of the spacing drum 30' being rolled into the cylindrical form of the periphery of the actual spacing drum 30.

Once a planar representation of the desired array of radial profiled flights 32', 32", 32''', 32'''', etc. is established, the array may be analytically or experimentally checked at the exit end 41' for adequate spacing between the flights 32', 32", 32''', 32'''', etc. to assure that each segment may exit the spacing drum 30' without interference from a proceeding flight.

Figure 7:
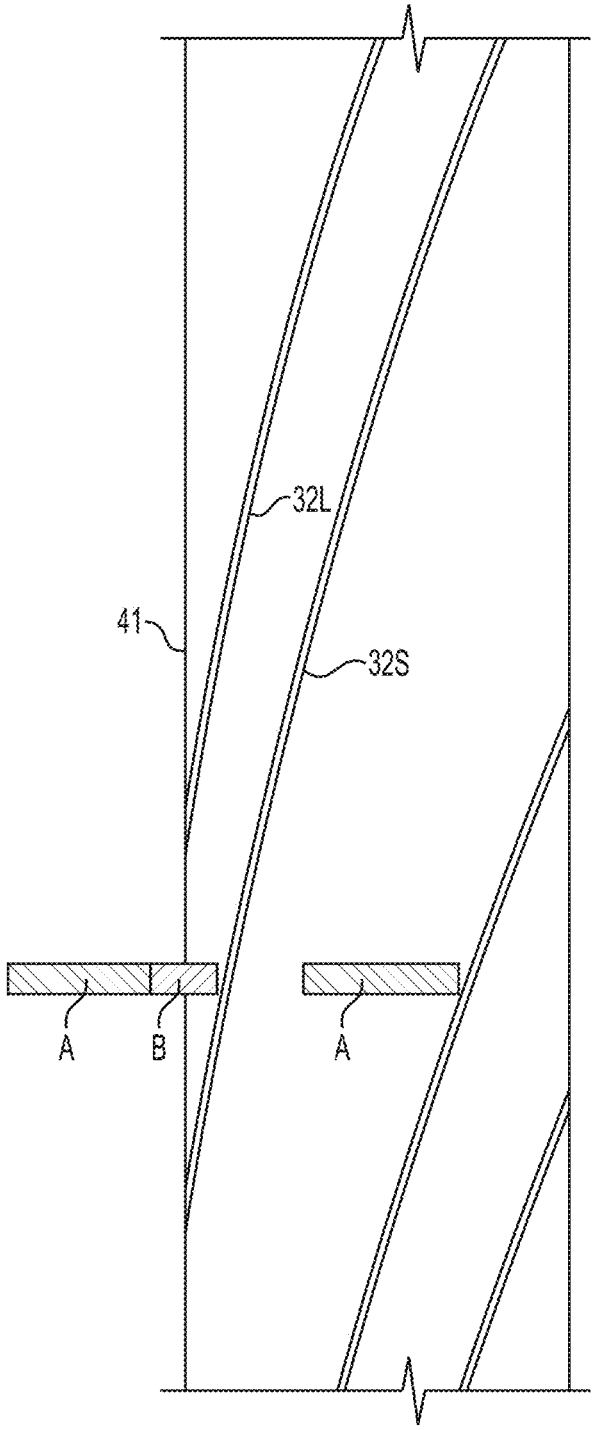
FIG. 7 is a detail view of another example embodiment of the spacing drum as viewed in the direction of arrow IV in FIG. 2C, according to some example embodiments.

Referring now also to FIG. 7, in an example embodiment where a segment A may be longer than a segment B, a radial profile flight 32L, which may move the longer segment A, may be terminated short of the very edge of the exit end 41 of the radial profile spacing drum 30 to provide requisite clearance for the shorter segment B as it approaches the exit end 41 while the shorter segment B is being moved by a radial profile flight 32S. In doing so, the longer segment A may still exit the drum 30 at a desired speed $v_2$ despite the shortening of the flight 32L which may be pushing it, because a significant portion of the longer segment A may come into contact with a moving plug wrap 54, which action assures withdrawal of the longer segment A from the exit end 41 of the spacing drum 30' at the desired speed $v_2$ and relative position.

In other example embodiments, the distances between flights may be different as shown in FIG. 7 (e.g., to accommodate different segment sizes or different desired resulting spacing between segments or other purposes). In some example embodiments, all the flights will continue all the way to the edge of the exit end 41 (such as shown FIGS. 4A and 8). In yet other example embodiments, all flights 32L and flights 32S may terminate short of the exit end 41 by equal or differing amounts.

Once a planar representation of the desired array of radial profiled flights 32', 32", 32'", 32"", etc. is established, the array may also be analytically or experimentally checked for adequate spacing between the flights 32', 32", 32'", 32"", etc. at the drum entrance 39' to assure that each segment (A, B) may enter drum 30' without interference from a preceding flight (that its leading edge portion 82 does not impinge upon the preceding flight upon entry into the spacing drum 30). Detection and/or prediction of interference at the entrance end 39' of the spacing drum 30' may be addressed by decreasing or increasing the radius R of each radial profile flight 32', 32", 32'", 32"", etc., while relocating the respective arc center A-C along the second centering line C-$L_2$ closer or farther to where the hypothetical, straight-line, exit flight (arc tangent) $T_1$' intersects exit end 41' of the spacing drum 30'. Changes in R, for example, will change the pitch at the entrance end 39' and increase or decrease the spacing 78 (FIG. 4) between flights (in the direction of the segment path 76') at the entrance end 39' of the planar spacing drum 30'.

In an example embodiment, an arcuate portion of the radial profile flight 32 adjacent the entrance end 39 of the spacing drum 30 may be circumferentially retracted (shifted) away from where a projection of the arc tangent $T_1$ (from the exit end 41) would cross the entrance end 39 of the spacing drum 30. A reduction in the radius R may increase this shift and may increase the spacing 78 between flights (in the direction of the segment path 76'), whereas an increase in the radius R may decrease the spacing 78 between flights (in the direction of the segment path 76').

Figure 8:
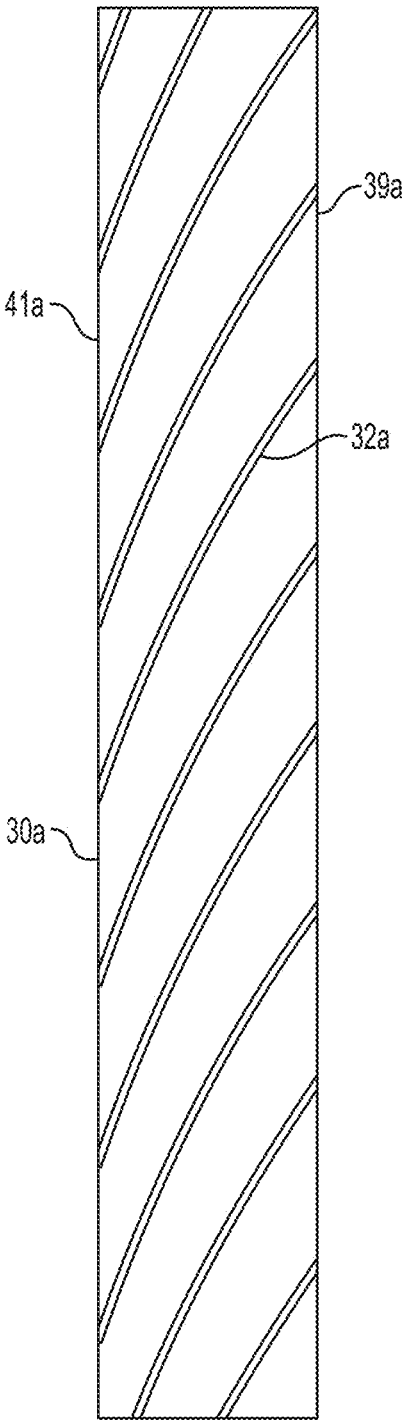
FIG. 8 is a planar representation of another example embodiment of the spacing drum in FIG. 2B.

Referring now to FIG. 8, the aforementioned geometrical relationships may be used to generate the depicted planar radial flight drum 30*a* comprising eight radial profile flights 32*a*, and entrance end 39*a* and an exit end 41*a*.

Figure 9A:
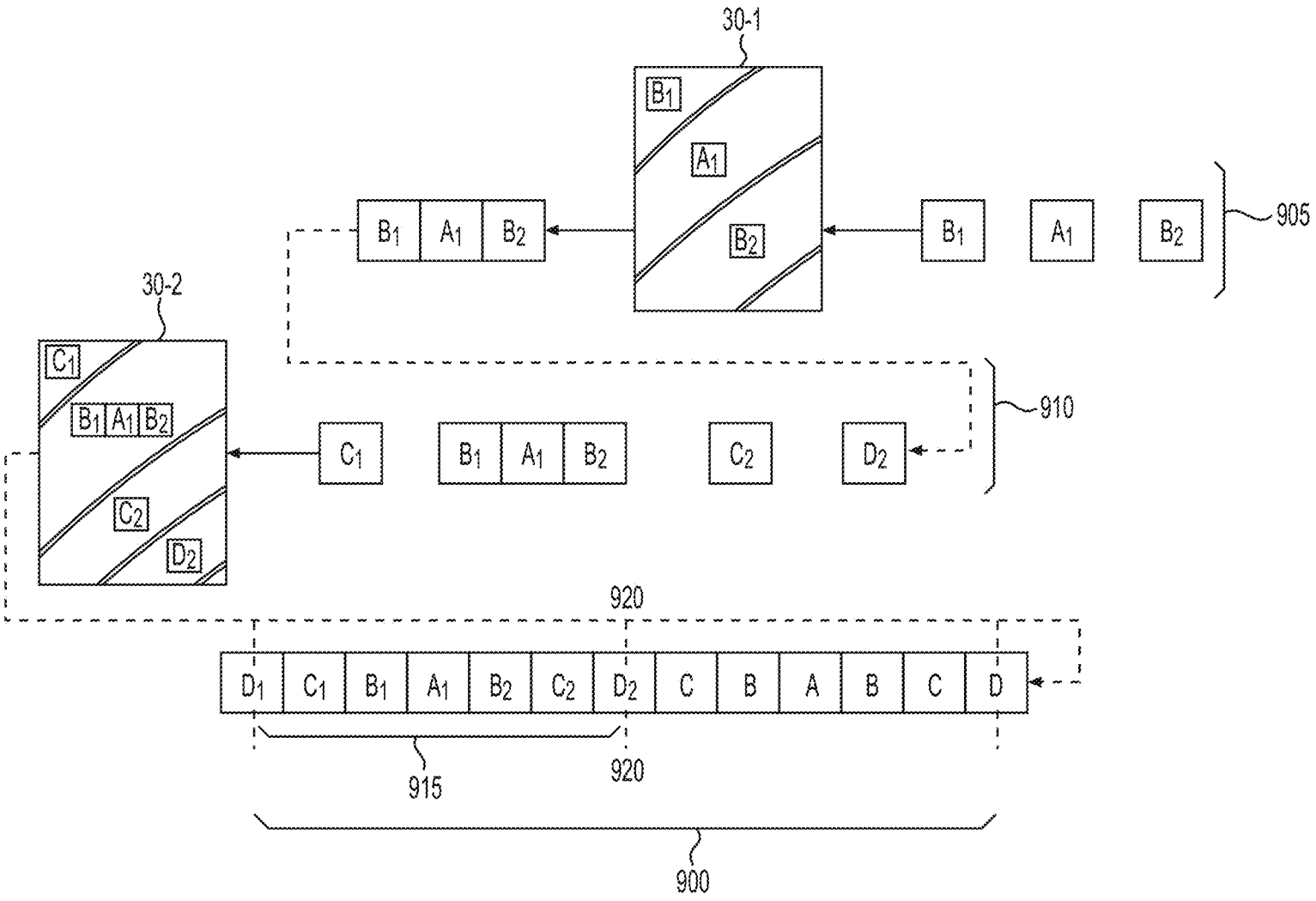
FIGS. 9A-9B is an example method of producing articles using example embodiments.
Figure 9B:
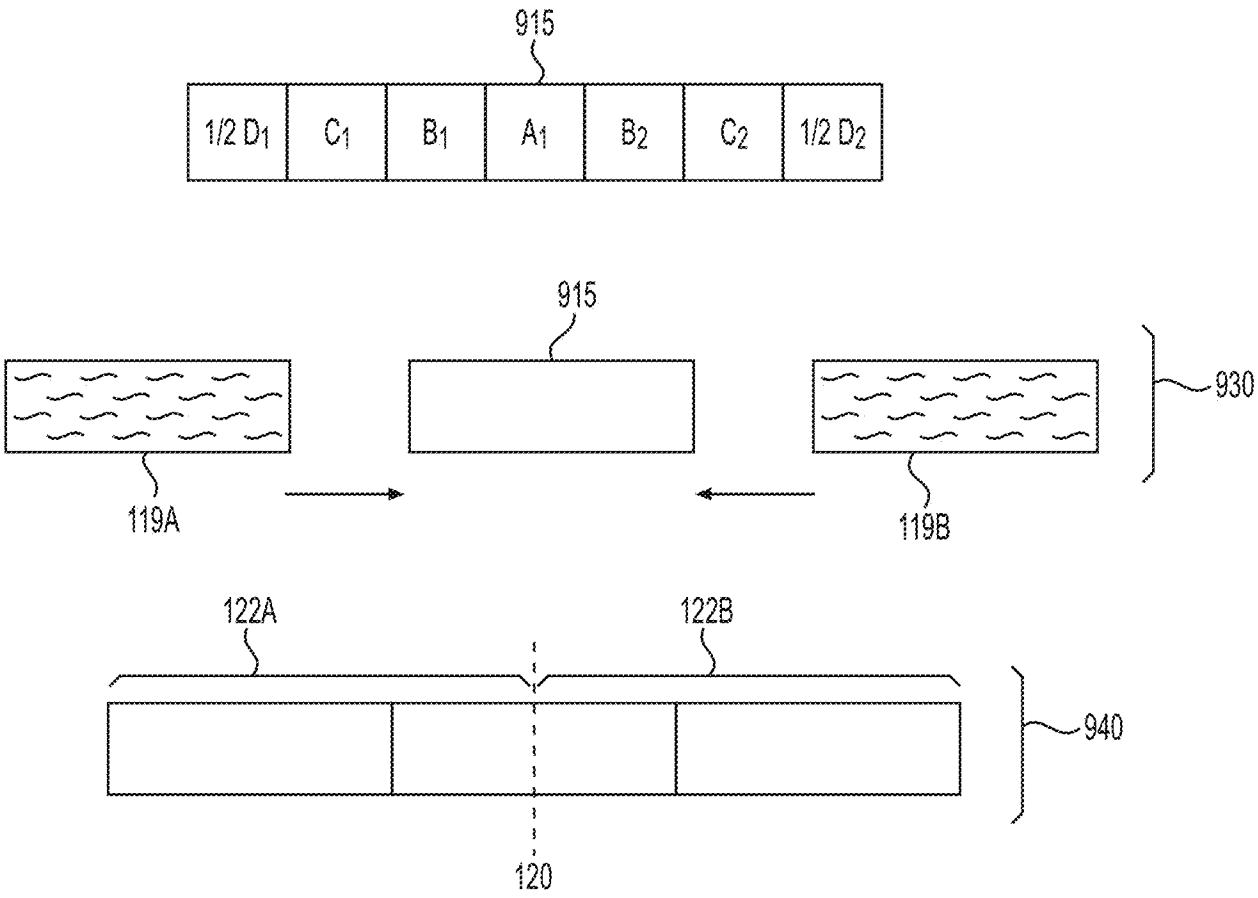

Referring now to FIGS. 9A-9B, example embodiments may be used to construct a continuous rod.

FIG. 9A illustrates a process for constructing a filter rod 915 from a continuous rod 900. The filter rod 915 may include a segment A, two segments B, two segments C. Further, the filter rod 915 may include a half of a segment D on each end of the filter rod 915. Each half of a segment D forms a mouthpiece. Segments A, B and C can be any known desired filter components such as a paper filter, cellulose acetate fiber, activated charcoal, etc.

More specifically, in some example embodiments, a half of a segment $D_1$ is at a first end of the filter rod 915. A segment $C_1$ is adjacent the segment $D_1$, a segment $B_1$ is adjacent the segment $C_1$, a segment $A_1$ is adjacent the segment $B_1$, a segment $B_2$ is adjacent the segment $A_1$, a segment $C_2$ is adjacent the segment $B_2$. A half of a segment $D_2$ is at a second end of the rod 900 and adjacent the segment $C_2$.

The continuous rod 900 may be constructed as follows. At stage 905, segments $B_1$, $A_1$ and $B_2$ are input into the drum 30-1 in that order. As shown, the segments $B_1$, $A_1$ and $B_2$ are on different flights, respectively. The metering wheel 208 associated with the second hopper section 200-2 may be timed to output two segments B for every single segment A output by the metering wheel 208 associated with the first hopper section 200-1. Moreover, the speed of the belt 38-1 and the output speed of the metering wheel 208 associated with the second hopper section 200-2 are such that a space between two segments B exist for a segment A.

In some example embodiments, the speed of the segments exiting the second radial spacing drum 30-2 match the tube belt speed which is a function of the finished filter and length of the segments A, B, C, D.

Moreover, the segments $B_1$, $A_1$ and $B_2$ may be spaced apart such that the segments $B_1$, $A_1$ and $B_2$ are input to different flights of the drum 30-1.

The drum 30-1 may output the segments $B_1$, $A_1$ and $B_2$ in that order. In the example embodiment shown in FIG. 9, the drum 30-1 outputs the segments $B_1$, $A_1$ and $B_2$ such that the segments $B_1$, $A_1$ and $B_2$ are adjacent and the segment $B_1$ touches the segment $A_1$ and the segment $A_1$ also touches the segment $B_2$.

At stage 910, segments $C_1$ and $C_2$ are output by the metering wheel 208 associated with the third hopper section 200-3 and the segment $D_2$ is output by the metering wheel 208 associated with the fourth hopper section 200-4.

The metering wheel 208 associated with the third hopper section 200-3 and the metering wheel 208 associated with the fourth hopper section 200-4 are timed such that the segment $C_1$ is output onto the belt 38-2 downstream of the combined segment $B_1$, $A_1$, $B_2$, the segment $C_2$ is output onto the belt 38-2 upstream of the combined segment $B_1$, $A_1$, $B_2$ and the segment $D_2$ is output onto the belt 38-2 upstream of the segment $C_2$.

The segment $C_1$, the combined segment $B_1$, $A_1$, $B_2$, the segment $C_2$ and the segment $D_2$ may be input to the drum 30-2 on different flights, respectively. More specifically, the segment $C_1$ is on a first flight, the combined segment $B_1$, $A_1$, $B_2$ is on a second flight, the segment $C_2$ is on a third flight and the segment $D_2$ is on a fourth flight.

The drum 30-2 may output the segment $C_1$, the combined segment $B_1$, $A_1$, $B_2$, the segment $C_2$ and the segment $D_2$ in that order. In the example embodiment shown in FIG. 9, the drum 30-2 outputs the segment $C_1$, the combined segment $B_1$, $A_1$, $B_2$, the segment $C_2$ and the segment $D_2$ such that the segment $C_1$ is adjacent to and contacts the combined segment $B_1$, $A_1$, $B_2$, the combined segment $B_1$, $A_1$, $B_2$ is adjacent to and contacts the segment $C_2$ and the segment $C_2$ is adjacent to and contacts the segment $D_2$.

Referring to FIGS. 9A-9B and to FIGS. 2F-2G, the cutter 48 may be timed to repetitively produce a filter rod 915 from the continuous rod 900. In cigarette making operations, each filter rod 915 may be fed to a tipping machine, wherein upon a series of drums, each filter rod 915 may be cut from the continuous rod (920), graded, aligned and then interposed between spaced apart pairs of tobacco rods 119*a,b* (930), which may then be closed upon the respective 2-up filter construction, wrapped centrally with a tipping paper 120 and then severed centrally to produce two complete cigarettes 122*a,b* (940). In such operations, utilization of the disclosed radial profile spacing drums 30-1 and 30-2 may provide a capacity to produce the rod 900.

In some example embodiments, the form of the radial profile flight 32 may be defined by a sweep of a radius R from the point of tangency 70 adjacent the exit end 41 of the drum 30 to a location 74 adjacent the entrance end 39 of the radial profile spacing drum 30 as previously described, but which instead of remaining constant throughout the sweep, the radius R may be increased or decreased in length as it progresses through the sweep from the point of tangency 70 at the exit end 41 of the drum 30 to a location 74 adjacent the entrance end 39 of the radial profile spacing drum 30. In some embodiments, the increase and/or decrease the length of R may be continuous. In various embodiments, the change in the length of R could be undertaken in the opposite direction, and a given spacing drum 30 may include a complete set of flights constructed in this manner, or a set of flights constructed in this manner and a set of flights constructed in the manner previously described.

While a number of example embodiments have been disclosed herein, it should be understood that other variations are possible. Such variations are not to be regarded as a departure from the spirit and scope of the present disclosure, and all such modifications as would be obvious to one skilled in the art are intended to be included within the scope of the following claims.

What is claimed is:

1. A system comprising:

a first dispenser configured to dispense a first plurality of segments on a first conveying path;

a second dispenser configured to dispense a second plurality of segments on the first conveying path;

a first spacing drum configured to receive a number of the first plurality of segments and the second plurality of segments per revolution of the first spacing drum and configured to release a pair of the first plurality of segments and the second plurality of segments on a second conveying path at a first segment-release spacing and a first segment-release speed along the second conveying path;

a third dispenser configured to dispense a third plurality of segments on the second conveying path;

a fourth dispenser configured to dispense a fourth plurality of segments on the second conveying path; and a second spacing drum configured to receive the pair of the first plurality of segments and the second plurality of segments and a number of the third plurality of segments and the fourth plurality of segments per revolution of the second spacing drum, the second spacing drum configured to release a set of the first plurality of segments, the second plurality of segments, the third plurality of segments, and the fourth plurality of segments on a third conveying path at a second segment-release spacing and a second segment-release speed along the third conveying path, the set of the first plurality of segments, the second plurality of segments, the third plurality of segments, and the fourth plurality of segments released by the second spacing drum forming a filter element.

2. The system of claim 1, further comprising:

a single wrapper configured to perform a single wrapping of the filter element.

3. The system of claim 2, wherein the single wrapper is a garniture.

4. The system of claim 1, wherein the first spacing drum includes radial flight profile including continuous arcs extending from a first side of the first spacing drum to a second side of the first spacing drum.

5. The system of claim 4, wherein the continuous arcs transition the pair of the first plurality of segments and the second plurality of segments from the first side of the first spacing drum to the second side of the first spacing drum by pushing the first plurality of segments and the second plurality of segments as the first plurality of segments and the second plurality of segments travel from the first side of the first spacing drum to the second side of the first spacing drum.

6. The system of claim 1, wherein the first conveying path and the second conveying path form a single conveying belt.

7. The system of claim 1, wherein a speed of the first conveying path is the same as a speed of the second conveying path.

8. The system of claim 1, wherein the segments are segments of a filter.

* * * * *